US009785076B2

(12) United States Patent
Kobayashi

(10) Patent No.: US 9,785,076 B2
(45) Date of Patent: Oct. 10, 2017

(54) TONER SET FOR ELECTROSTATIC IMAGE DEVELOPMENT, DEVELOPER SET FOR ELECTROSTATIC IMAGE DEVELOPMENT, PROCESS CARTRIDGE SET, IMAGE FORMING APPARATUS, AND IMAGE FORMING METHOD

(71) Applicant: FUJI XEROX CO., LTD., Tokyo (JP)

(72) Inventor: Hiroko Kobayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/081,368

(22) Filed: Mar. 25, 2016

(65) Prior Publication Data

US 2016/0209768 A1 Jul. 21, 2016

Related U.S. Application Data

(60) Division of application No. 14/488,969, filed on Sep. 17, 2014, which is a continuation of application No. 13/211,702, filed on Aug. 17, 2011, now abandoned.

(30) Foreign Application Priority Data

Mar. 23, 2011 (JP) ..... 2011-064676

(51) Int. Cl.
*G03G 9/09* (2006.01)
*G03G 9/08* (2006.01)
(Continued)

(52) U.S. Cl.
CPC ..... *G03G 9/092* (2013.01); *G03G 9/0821* (2013.01); *G03G 9/08795* (2013.01);
(Continued)

(58) Field of Classification Search
CPC ..... G03G 9/091
See application file for complete search history.

(56) References Cited

U.S. PATENT DOCUMENTS

2004/0013958 A1 1/2004 Ayaki et al.
2004/0058258 A1 3/2004 Yoshino et al.
(Continued)

FOREIGN PATENT DOCUMENTS

CN 101114136 A 1/2008
CN 101226347 A 7/2008
(Continued)

OTHER PUBLICATIONS

May 13, 2016 Office Action Issued in U.S. Appl. No. 14/488,969.
(Continued)

*Primary Examiner* — Hoa V Le
(74) *Attorney, Agent, or Firm* — Oliff PLC

(57) ABSTRACT

A toner set for electrostatic image development includes a cyan toner, a magenta toner, and a yellow toner, wherein the Vicat softening temperatures of the toners are respectively in the range of from about 30° C. to about 60° C., and among the toners, the difference between the Vicat softening temperature of the toner having the highest Vicat softening temperature and the Vicat softening temperature of the toner having the lowest Vicat softening temperature is from about 1° C. to about 5° C.

10 Claims, 2 Drawing Sheets

(51) Int. Cl.
*G03G 9/087* (2006.01)
*G03G 9/097* (2006.01)
*G03G 21/18* (2006.01)

(52) U.S. Cl.
CPC ..... *G03G 9/08797* (2013.01); *G03G 9/09* (2013.01); *G03G 9/091* (2013.01); *G03G 9/0906* (2013.01); *G03G 9/0918* (2013.01); *G03G 9/09708* (2013.01); *G03G 21/18* (2013.01); *G03G 2215/025* (2013.01); *G03G 2215/0604* (2013.01)

(56) References Cited

U.S. PATENT DOCUMENTS

| | | | | |
|---|---|---|---|---|
| 2005/0164109 | A1 | 7/2005 | Iizuka et al. | |
| 2006/0013623 | A1 | 1/2006 | Kagawa et al. | |
| 2007/0166636 | A1 | 7/2007 | Daimon et al. | |
| 2008/0025754 | A1 | 1/2008 | Ishiyama et al. | |
| 2008/0171273 | A1 | 7/2008 | Cheong et al. | |
| 2008/0261131 | A1 | 10/2008 | Nakayama et al. | |
| 2009/0028617 | A1 | 1/2009 | Katakabe et al. | |
| 2009/0123186 | A1 | 5/2009 | Sugiura et al. | |
| 2009/0246656 | A1 | 10/2009 | Kouyama et al. | |
| 2009/0286176 | A1 | 11/2009 | Ohmura et al. | |
| 2010/0151377 | A1* | 6/2010 | Uchino ..... | G03G 9/0825 430/110.2 |
| 2010/0167197 | A1 | 7/2010 | Yuasa et al. | |
| 2010/0183964 | A1 | 7/2010 | Yoshida et al. | |
| 2010/0203442 | A1 | 8/2010 | Ohmura et al. | |
| 2010/0216068 | A1* | 8/2010 | Kotsugai ..... | G03G 9/08755 430/109.4 |
| 2011/0008720 | A1 | 1/2011 | Yasukawa et al. | |
| 2011/0053072 | A1 | 3/2011 | Kuramashi | |
| 2011/0207037 | A1* | 8/2011 | Yasukawa ..... | G03G 9/091 430/42.1 |
| 2011/0217651 | A1 | 9/2011 | Hayata et al. | |

FOREIGN PATENT DOCUMENTS

| | | | |
|---|---|---|---|
| CN | 101788771 | A | 7/2010 |
| JP | 11202555 | A | 7/1999 |
| JP | 2004151196 | A | 5/2004 |
| JP | 2004279740 | A | 10/2004 |
| JP | 2005-352116 | A | 12/2005 |

OTHER PUBLICATIONS

Oct. 10, 2014 Office Action issued in Chinese Application No. 201110301750.9.
Dec. 8, 2014 Office Action issued in Japanese Patent Application No. 2011-064676.
Feb. 5, 2016 Office Action issued in U.S. Appl. No. 14/488,969.
Sep. 21, 2015 Office Action issued in U.S. Appl. No. 14/488,969.
Mar. 17, 2014 Office Action issued in U.S. Appl. No. 13/211,702.
Aug. 22, 2013 Office Action issued in U.S. Appl. No. 13/211,702.
Feb. 25, 2013 Office Action issued in U.S. Appl. No. 13/211,702.
Dec. 22, 2016 Office Action Issued in U.S. Appl. No. 14/488,969.

* cited by examiner

TONER SET FOR ELECTROSTATIC IMAGE DEVELOPMENT, DEVELOPER SET FOR ELECTROSTATIC IMAGE DEVELOPMENT, PROCESS CARTRIDGE SET, IMAGE FORMING APPARATUS, AND IMAGE FORMING METHOD

CROSS-REFERENCE TO THE RELATED APPLICATIONS

This application is a divisional application of U.S. patent application Ser. No. 14/488,969 filed Sep. 17, 2014, which is a continuation application of U.S. patent application Ser. No. 13/211,702, filed Aug. 17, 2011, which claims priority under 35 U.S.C. §119 to Japanese Patent Application No. 2011-064676 filed Mar. 23, 2011, the entire disclosures of which are expressly incorporated by reference herein.

BACKGROUND

1. Technical Field

The present invention relates to a toner set for electrostatic image development, a developer set for electrostatic image development, a process cartridge set, an image forming apparatus, and an image forming method.

2. Related Art

In recent years, image forming apparatuses represented by printers and copying machines have been widely popularized, and technologies related to various elements that constitute the image forming apparatuses have also been widely distributed. Among those image forming apparatuses, in many of image forming apparatuses employing an electrophotographic system, a photoreceptor (image holding member) using a charging apparatus, and forming an electrostatic latent image having a potential that is different from the ambient potential, on the charged photoreceptor. The electrostatic latent image thus formed is developed with a toner, and then is finally transferred onto a recording medium such as a recording paper.

SUMMARY

According to an aspect of the invention, there is provided a toner set for electrostatic image development including a cyan toner, a magenta toner and a yellow toner, in which the Vicat softening temperatures of the toners are in the range of from about 30° C. to about 60° C., and among the toners, the difference between the Vicat softening temperature of the toner having the highest Vicat softening temperature and the Vicat softening temperature of the toner having the lowest Vicat softening temperature is from about 1° C. to about 5° C.

BRIEF DESCRIPTION OF THE DRAWINGS

Exemplary embodiments of the present invention will be described in detail based on the following figures, wherein.

DETAILED DESCRIPTION

Figure 1:
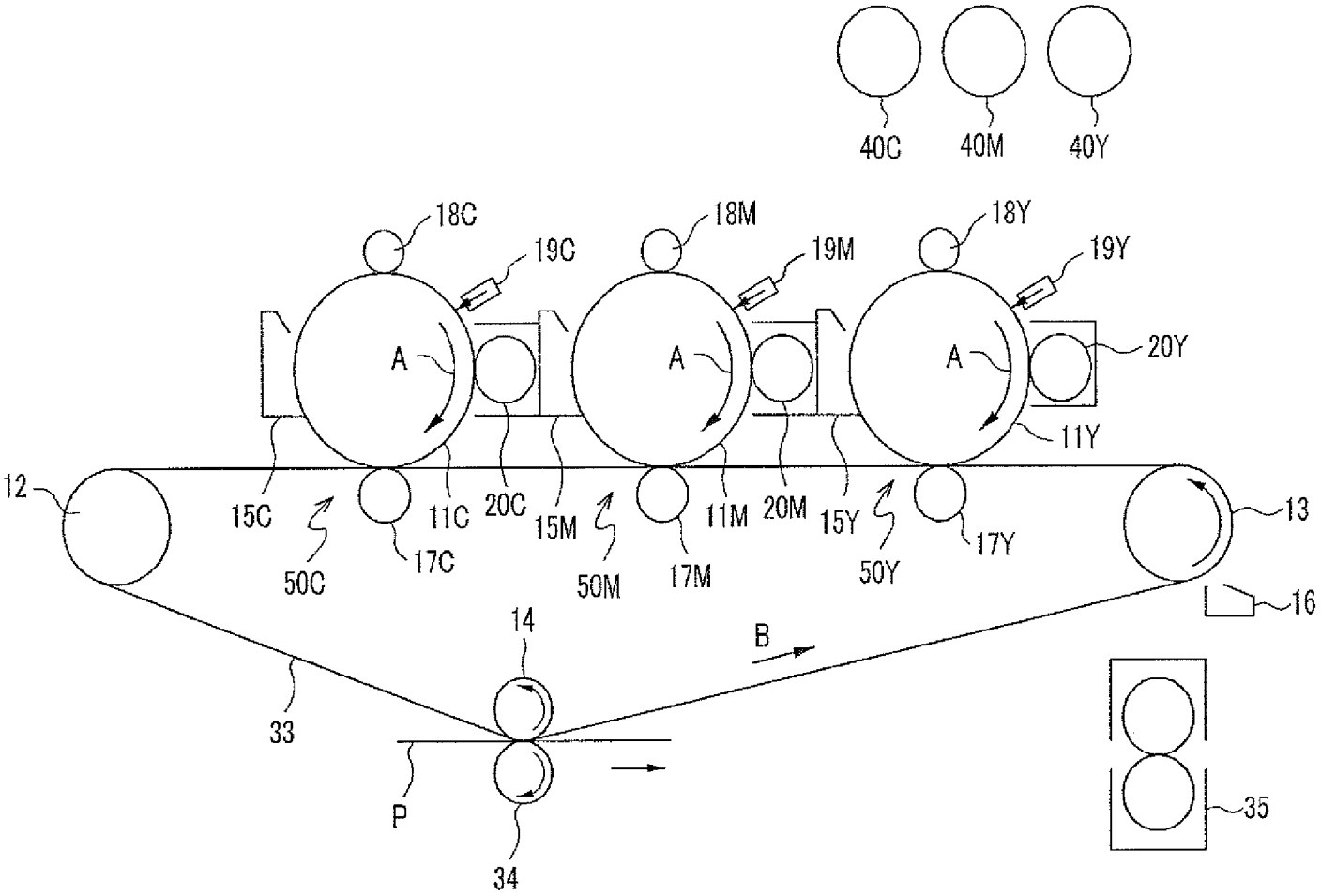
FIG. 1 is a schematic configuration diagram showing an image forming apparatus according to an exemplary embodiment of the invention.

Hereinafter, exemplary embodiments of the invention will be described.

(Toner Set for Electrostatic Image Development)

The toner set for electrostatic image development (hereinafter, referred to as "toner set") according to an exemplary embodiment of the invention is composed of at least a cyan toner, a magenta toner and a yellow toner. If necessary, the toner set may have a black toner, and toners of other intermediate colors.

The cyan toner, magenta toner and yellow toner have Vicat softening temperatures in the range of from 30° C. to 60° C. (or from about 30° C. to about 60° C.), and among these toners, the difference between the Vicat softening temperature of the toner having the highest Vicat softening temperature and the Vicat softening temperature of the toner having the lowest Vicat softening temperature is from 1° C. to 5° C. (or from about 1° C. to about 5° C.).

Also, in the case of using a black toner and toners of other intermediate colors, the Vicat softening temperatures of the toners are desirably in the range of from 30° C. to 60° C. (or from about 30° C. to about 60° C.).

Here, it is conventionally known to control the glass transition temperature, the softening temperature or the melt viscosity of a binder resin, which is a main component of toner (toner particles), for the purpose of mitigating fixing failures (for example, melting irregularity, and crease (folding resistance) of the fixed image). In general, the glass transition temperature or the softening temperature is low, and the fixing temperature is lowered when the melt viscosity at a specific temperature is decreased. However, since penetrating of a fixed image into paper, or offset at a high temperature is easy to occur, it is desirable to control the glass transition temperature, the softening temperature or the melt viscosity to be in an appropriate range.

However, it has been known that even though fixing failures (for example, melting irregularity, and crease (folding resistance) of the fixed image) are mitigated by the controlling, when color fixed images are continuously printed, image peeling or cracking between fixed images of different colors occurs.

The mechanism of the occurrence of this cracking between fixed images of different colors is thought to be as follows.

Typically, the toner that forms an unfixed image on a medium to be transferred (hereinafter, may be described as paper) is fixed by adhering to the paper by the fixing heat provided by a fixing apparatus, and due to the adherence between toner particles (toner particle).

At that time, the volume of the binder resin that constitutes the toner expands under heating, but usually, as the paper after fixing is discharged out of the image forming apparatus, the binder resin is brought into contact with air and cooled to contract.

However, in the case of continuous printing, since a sheet of newly fixed paper is piled upon another sheet of fixed paper, the time for contact with air and cooling such as described above is limited. As a result, the heat of the fixed images formed on the paper after fixing is accumulated, and the volume remains expanded. This phenomenon is such that particularly in the case of performing printing by forming images in a large quantity at high speed, the expansion of volume of the fixed images becomes conspicuous.

Therefore, it is thought that in a fixed image in which the binder resin that constitutes the toner has expanded, the heat of the fixed image is slowly cooled, but the mode of contraction differs between the fixed images of different colors.

For example, when a fixed image of cyan (C), magenta (M) and yellow (Y) colors is formed, the colors are reproduced with the toners of the respective colors of CMY, and in accordance with the colors reproduced, the fixed image may have a range of toner layers, from a toner layer composed of a single layer (one layer) formed from the toner of each of the colors of CMY, to a toner layer composed of three layers formed from the toners of all three colors of CMY laminated together.

Figure 2A:
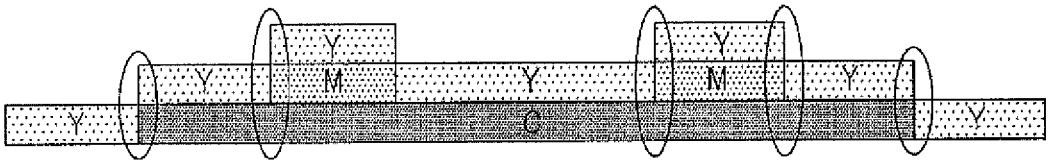
FIGS. 2A and 2B are schematic diagrams for explaining the lamination state of the toners constituting a fixed image in accordance with the colors to be reproduced.
Figure 2B:
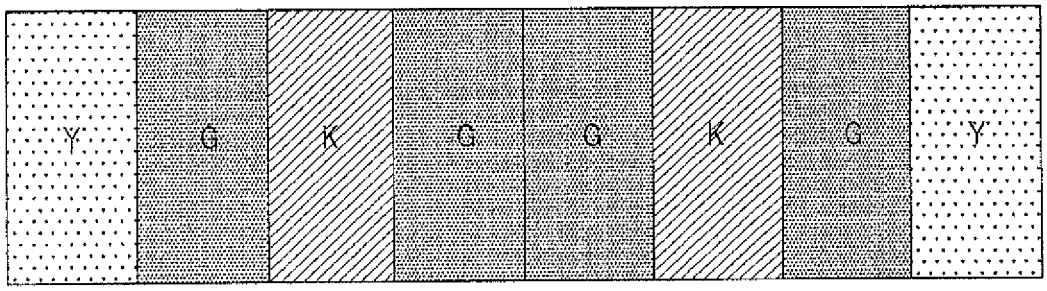

Specifically, as shown in FIG. 2, for example, when a fixed image of black (K), green (G) and yellow (Y) colors is formed (see FIG. 2B: FIG. 2B is a top view of a fixed image), the fixed image of K (black) color is composed of a laminate of three layers such as a cyan toner layer (in FIG. 2, indicated by C), a magenta toner layer (in FIG. 2, indicated by M), and a yellow toner layer (in FIG. 2, indicated by Y), and the fixed image of G (green) color is composed of a laminate of two layers such as a cyan toner layer and a magenta toner layer. The fixed image of K (black) color is composed of a single layer of a yellow toner layer (see FIG. 2A: FIG. 2A is a cross-sectional view of an unfixed image).

For this reason, the fixed images differ in the stacking of toner layers due to the colors to be reproduced. Therefore, it is thought that the volume of the binder resin of the toner has different rates of contraction depending on the color of the fixed image, and the different rates of contraction cause differences in stress between fixed images of different colors (see the area surrounded by an ellipse in FIG. 2A).

That is, a fixed image composed of plural toner layers takes more time in cooling than a fixed image composed of a single toner layer, since the toner layers are laminated. Therefore, it is thought that stress is likely to be concentrated at the boundary areas of fixed images having different thicknesses of toner layers, and this causes differences in stress between fixed images of different colors (see the area surrounded by an ellipse in FIG. 2A), while causing the occurrence of image peeling or cracking between fixed images of different colors.

Furthermore, it is thought that when the differences in stress between fixed images of different colors become excessive, this excess causes the occurrence of image peeling or image peeling.

On the contrary, as the toner set according to the exemplary embodiment of the invention has a constitution such as described above, cracking that occurs between fixed images of different colors is suppressed. Further, image peeling, which occurs together with cracking, is also suppressed.

Here, the Vicat softening temperature is also called Vicat penetration temperature (Vikat Formbestandigkeit), and is an indicator showing the thermal characteristics of a toner as a fixed image obtained after fixing. This temperature is an indicator showing the deformation properties under a heat or force weaker than the melt viscosity measured by a conventional flow tester.

That is, it is thought that when the Vicat softening temperature is controlled, the thermal deformation properties of a toner as a fixed image obtained after fixing are controlled.

For this reason, it is thought that when the Vicat softening temperatures of the cyan toner, magenta toner and yellow toner are adjusted to be in the range of from 30° C. to 60° C., and then among the toners, the difference between the Vicat softening temperature of the toner having the highest Vicat softening temperature and the Vicat softening temperature of the toner having the lowest Vicat softening temperature is adjusted to a value from 1° C. to 5° C., the difference between the degrees of deformation under heat (that is, the degree of expansion of the binder resin under heat and contraction of the binder resin under cooling) between fixed images of different colors (that is, between fixed images having different thicknesses of toner layer) is mitigated, and thus the stress concentration that occurs at the boundary areas between the fixed images of different colors is relieved. As a result, the occurrence of image peeling or cracking that occurs between fixed images of different colors is suppressed.

The toner set according to the exemplary embodiment of the invention can suppress the occurrence of image peeling or cracking that occurs between fixed images of different colors, even if the toner set is applied particularly to an image forming apparatus (for example, an image forming apparatus which includes a pair of rotating members having paper (medium to be transferred) nipped between the rotating members and conducting fixing, with the rotating members being arranged to be in contact with each other at a contact area having a width of from 3 mm to 10 mm (or from about 3 mm to about 10 mm), and includes a fixing apparatus with the fixing time adjusted to from 10 ms to 40 ms (or from about 10 ms to about 40 ms)), for which it is considered that the occurrence of image peeling or cracking between fixed images of different colors is prone to occur, and in which heat or pressure is not easily applied to the toner image during fixing, and paper obtained after fixing can be piled in a short time so that the time for the fixed images to be in contact with air (cooling time) is short.

When the melt viscosity based on a flow tester, which is a conventional indicator of thermal characteristics, is employed, the slight difference in thermal deformation between fixed images of different colors may not be measured. Furthermore, since the glass transition temperature or softening temperature barely reflects the slight changes in the mobility of composition in a toner, the glass transition temperature or softening temperature does not serve as an indicator showing the thermal characteristics of fixed images.

Therefore, although the respective toners show values that are close to each other in terms of the glass transition temperature, softening temperature or melt viscosity of the binder resin as a main component, as in the case of conventional toner sets, the occurrence of cracking that occurs between fixed images of different colors, or of image peeling is not mitigated.

For the toner set according to the exemplary embodiment of the invention, the Vicat softening temperatures of the toners of different colors are all in the range of from 30° C. to 60° C. (or from about 30° C. to about 60° C.), but the Vicat softening temperatures are preferably from 35° C. to 55° C. (or from about 35° C. to about 55° C.), and more preferably from 40° C. to 50° C. (or from about 40° C. to about 50° C.).

If this Vicat softening temperature is too high, the difference in the expanded volume of the binder resin between the fixed images of different colors is so large, and as a result, the difference in volume contraction is increased. Then, cracking between fixed images of different colors easily occurs, and image peeling easily occurs.

If this Vicat softening temperature is too low, only the top layer of the toner layers constituting a fixed image can easily melt, and thus a portion of the fixed image may peel off.

Furthermore, among all the color toners, the difference between the Vicat softening temperature of the toner having the highest Vicat softening temperature and the Vicat softening temperature of the toner having the lowest Vicat softening temperature (hereinafter, referred to as Vicat softening temperature difference) is from 1° C. to 5° C. (or from about 1° C. to about 5° C.), but is desirably from 1° C. to 3° C. (or from about 1° C. to about 3° C.).

If this Vicat softening temperature difference is too large, the difference in the volume contraction of binder resins between the fixed images of different colors is large, and the occurrence of cracking or image peeling is prone to be caused.

If this Vicat softening temperature difference is too small, there is a need to adjust the amount of pigment. Since there are many occasions in which the color developability varies with the kind of pigment, and it is difficult to control the pigment concentration, for example, in the case of reproducing an intermediate color by using colorants having weak color developability, the reproducibility of the intermediate color is deteriorated under the influence of the colorants having weak color developability.

Furthermore, among the cyan toner, magenta toner and yellow toner, the toner having the highest Vicat softening temperature and the toner having the lowest Vicat softening temperature may be any toners; however, for example, it is desirable that the toner having the highest Vicat softening temperature be the yellow toner, and the toner having the lowest Vicat softening temperature be a toner of another color (for example, any of the cyan toner and the magenta toner).

This is since yellow colorants that are included in the yellow toner (yellow toner particles) generally have weaker color developability as compared with other colors, it is desirable to increase the Vicat softening temperature while increasing the color developability of the yellow toner by incorporating the colorants in large amounts and imparting the colorants with a function as a filler (filler material).

In order to adjust the Vicat softening temperature of each toner, for example, (1) a method of selecting the type of the binder resin, (2) a method of adjusting the type and the amount of the colorant, (3) a method of adjusting the type and the amount of a release agent, (4) a method of adjusting the type and the amount of an external additive, and (5) a method of adjusting the structure and the composition of the toner, may be used.

More specific examples include (1) a method of increasing the molecular weight by using a resin with higher polarity, (2) a method of using more of a pigment having an azo group, (3) a method of using a large amount of a release agent having a high melting temperature, (4) a method of using more of an external additive having a shape that is larger and irregular, and (5) a method of making the toner particles have a core-shell structure. In practice, the Vicat softening temperature of each toner may be adjusted with high accuracy by combining these methods.

The Vicat softening temperature is a value measured according to JIS K7206.

Specifically, a defined specimen is produced using a target toner, and the produced specimen is placed in a heating bath. While an edge face having a certain cross-sectional area (1 $mm^2$ according to JIS K7206) is pressed down at the center of the specimen, the temperature of the heating bath is increased. The temperature at which the edge face has penetrated into the specimen to a certain depth is defined as the Vicat softening temperature (see JIS K7206).

Hereinafter, the constitution of each toner of the toner set according to the exemplary embodiment of the invention will be described.

In addition, the toner set according to the exemplary embodiment of the invention is composed of a cyan toner, a magenta toner, a yellow toner, and if necessary, toners of other colors such as a black toner. However, since it is desirable that the toners have a constitution with identical fundamental components except for the colorant, hereinafter, the respective toners are collectively referred to as a toner according to the exemplary embodiment of the invention, and the constitution of the toner will be explained.

The toner according to the exemplary embodiment of the invention is constituted to include toner particles and an external additive.

The toner particles will be described.

The toner particles include, for example, a binder resin, a colorant, and if necessary, other additives such as a release agent.

There are no particular limitations on the binder resin, but examples of the binder resin include styrenes such as styrene, para-chlorostyrene and α-methylstyrene; esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; homopolymers such as polyolefins formed from monomers such as ethylene, propylene and butadiene, and copolymers obtainable by mixing two or more of these monomers; and mixtures thereof. Further examples include an epoxy resin, a polyester resin, a polyurethane resin, a polyamide resin, a cellulose resin, a polyether resin, a non-vinyl condensed resin; mixtures of these with the above-described vinyl resins; and graft polymers obtained by polymerizing vinyl-based monomers in the co-presence of these monomers.

A styrene resin, a (meth)acrylic resin, and a styrene-(meth)acrylic copolymer resin is obtained by, for example, a known method using a styrene-based monomer and a (meth)acrylic acid-based monomer alone or in appropriate combination. The term "(meth)acrylic" is an expression including both "acrylic" and "methacrylic".

The polyester resin is obtained by selecting a suitable combination of monomers from polyvalent carboxylic acids and polyhydric alcohols, and synthesizing the resin by using a conventionally known method such as, for example, a transesterification method or a polycondensation method.

When a styrene resin, a (meth)acrylic resin and copolymer resins of these are used as binder resins, it is preferable to use a resin having a weight average molecular weight Mw in the range of from 20,000 to 100,000, and a number average molecular weight Mn in the range of from 2,000 to 30,000. On the other hand, when a polyester resin is used as a binder resin, it is preferable to use a resin having a weight average molecular weight Mw in the range of from 5,000 to 40,000, and a number average molecular weight Mn in the range of from 2,000 to 10,000.

The colorant will be described.

The colorant is selected from known colorants, in accordance with the color of the intended toner.

Examples of a cyan colorant include copper phthalocyanine compounds and derivatives thereof, anthraquinone compounds, and basic dye lake compounds. Specific examples include cyan pigments such as C.I. Pigment Blue 1, C.I. Pigment Blue 2, C.I. Pigment Blue 3, C.I. Pigment Blue 4, C.I. Pigment Blue 5, C.I. Pigment Blue 6, C.I. Pigment Blue 7, C.I. Pigment Blue 10, C.I. Pigment Blue 11, C.I. Pigment Blue 12, C.I. Pigment Blue 13, C.I. Pigment Blue 14, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 15:6, C.I. Pigment Blue 16, C.I. Pigment Blue 17, C.I. Pigment Blue 23, C.I. Pigment Blue 60, C.I. Pigment Blue 65, C.I. Pigment Blue 73, C.I. Pigment Blue 83, C.I. Pigment Blue 180; C.I. Vat Cyan 1, C.I. Vat Cyan 3, C.I. Vat Cyan 20; Prussian blue, cobalt blue, alkali blue lake, phthalocyanine blue, metal-free Phthalocyanine Blue, partial chlorination products of Phthalocyanine Blue, Fast Sky Blue, and Indanthrene Blue BC; and cyan dyes such as C.I. Solvent Cyan 79 and 162.

Examples of a magenta colorant include condensed azo compounds, diketopyrrolopyrrole compounds, anthraquinone, quinacridone compounds, basic dye lake compounds, naphthol compounds, benzimidazole compounds, thioindigo compounds, and perylene compounds. Specific examples include magenta pigments such as C.I. Pigment Red 1, C.I. Pigment Red 2, C.I. Pigment Red 3, C.I. Pigment Red 4, C.I. Pigment Red 5, C.I. Pigment Red 6, C.I. Pigment Red 7, C.I. Pigment Red 8, C.I. Pigment Red 9, C.I. Pigment Red 10, C.I. Pigment Red 11, C.I. Pigment Red 12, C.I. Pigment Red 13, C.I. Pigment Red 14, C.I. Pigment Red 15, C.I. Pigment Red 16, C.I. Pigment Red 17, C.I. Pigment Red 18, C.I. Pigment Red 19, C.I. Pigment Red 21, C.I. Pigment Red 22, C.I. Pigment Red 23, C.I. Pigment Red 30, C.I. Pigment Red 31, C.I. Pigment Red 32, C.I. Pigment Red 37, C.I. Pigment Red 38, C.I. Pigment Red 39, C.I. Pigment Red 40, C.I. Pigment Red 41, C.I. Pigment Red 48, C.I. Pigment Red 49, C.I. Pigment Red 50, C.I. Pigment Red 51, C.I. Pigment Red 52, C.I. Pigment Red 53, C.I. Pigment Red 54, C.I. Pigment Red 55, C.I. Pigment Red 57, C.I. Pigment Red 58, C.I. Pigment Red 60, C.I. Pigment Red 63, C.I. Pigment Red 64, C.I. Pigment Red 68, C.I. Pigment Red 81, C.I. Pigment Red 83, C.I. Pigment Red 87, C.I. Pigment Red 88, C.I. Pigment Red 89, C.I. Pigment Red 90, C.I. Pigment Red 112, C.I. Pigment Red 114, C.I. Pigment Red 122, C.I. Pigment Red 123, C.I. Pigment Red 163, C.I. Pigment Red 184, C.I. Pigment Red 202, C.I. Pigment Red 206, C.I. Pigment Red 207, C.I. Pigment Red 209, Pigment Violet 19; magenta dyes such as C.I. Solvent Red 1, C.I. Solvent Red 3, C.I. Solvent Red 8, C.I. Solvent Red 23, C.I. Solvent Red 24, C.I. Solvent Red 25, C.I. Solvent Red 27, C.I. Solvent Red 30, C.I. Solvent Red 49, C.I. Solvent Red 81, C.I. Solvent Red 82, C.I. Solvent Red 83, C.I. Solvent Red 84, C.I. Solvent Red 100, C.I. Solvent Red 109, C.I. Solvent Red 121; C.I. Disperse Red 9; C.I. Basic Red 1, C.I. Basic Red 2, C.I. Basic Red 9, C.I. Basic Red 12, C.I. Basic Red 13, C.I. Basic Red 14, C.I. Basic Red 15, C.I. Basic Red 17, C.I. Basic Red 18, C.I. Basic Red 22, C.I. Basic Red 23, C.I. Basic Red 24, C.I. Basic Red 27, C.I. Basic Red 29, C.I. Basic Red 32, C.I. Basic Red 34, C.I. Basic Red 35, C.I. Basic Red 36, C.I. Basic Red 37, C.I. Basic Red 38, C.I. Basic Red 39, and C.I. Basic Red 40; red iron oxide, Cadmium Red, minium, mercury sulfide, cadmium, Permanent Red 4R, lithol red, pyrazolone red, watching Red, calcium salts, Lake Red D, Brilliant Carmine 6B, Eosin Lake, Rhodamine Lake B, alizarin lake, and Brilliant Carmine 3B.

Examples of a yellow colorant include condensed azo compounds, isoindolinone compounds, anthraquinone compounds, azo metal complexes, methine compounds, and allylamide compounds. Specific examples include yellow pigments such as C.I. Pigment Yellow 2, C.I. Pigment Yellow 3, C.I. Pigment Yellow 15, C.I. Pigment Yellow 16, C.I. Pigment Yellow 17, C.I. Pigment Yellow 97, C.I. Pigment Yellow 180, C.I. Pigment Yellow 185, and C.I. Pigment Yellow 139.

Examples of a black colorant include carbon black (acetylene black, furnace black, thermal black, channel black, and ketjen black), copper oxide, manganese dioxide, aniline black, titanium black, activated carbon, non-magnetic ferrite, and magnetite.

Among these, pigments having azo groups (for example, condensed azo compounds and azo metal complexes) are suitable as the colorant.

Since the pigments having azo groups have weaker color developability as compared with other colorants, the pigments have a higher degree of freedom in the content with respect to the toner particles, and are favorable from the viewpoint that the Vicat temperatures of the toners of various colors, and the Vicat temperature differences between the toners of various colors can be easily adjusted. Furthermore, the pigments having azo groups have diverse structures as compared with other colorants, and if there are similar parts even in a portion of the resin structure which is a series of a monomer composition that is relatively simpler than pigments, the state in which heat can be easily retained is relieved by incorporating pigments. Therefore, it is thought that the pigments accomplish a function of decreasing the thermoresponsiveness of the binder resin (that is, for example, suppressing the expansion of the binder resin due to heat). As a result, the occurrence of image peeling or cracking that occurs between fixed images of different colors, is easily suppressed.

Particularly, since yellow colorants have weaker color developability as compared with other colors, in order to induce the necessary color developability, there is a tendency that the yellow colorants need to be incorporated into the toner particles in large amounts. Therefore, when a pigment having an azo group is applied as a yellow colorant, it is favorable to increase the color developability of the yellow toner, while adjusting the Vicat temperature of the yellow toner. As a result, the occurrence of image peeling or cracking that occurs between fixed images of different colors, is easily suppressed.

A pigment having an azo group is, for example, a pigment synthesized by an azonization reaction in the presence of a mineral acid represented by hydrochloric acid, and specific examples include Fast Yellow, Disazo Yellow, Pyrazolone Red, Chelate Red, Brilliant Carmine, and Para Brown.

In regard to the colorant, a surface-treated colorant may be used as necessary, and may be used in combination with a dispersant. Furthermore, plural kinds of colorants may also be used in combination.

The content of the colorant is desirably in the range of from 1 part by mass to 30 parts by mass, based on 100 parts by mass of the binder resin.

The release agent will be described.

Examples of the release agent include hydrocarbon-based waxes; natural waxes such as carnauba wax, rice wax, and candelilla wax; synthetic or mineral/petroleum-based waxes such as montan wax; and ester-based waxes such as fatty acid esters, and montanic acid esters, but the examples are not intended to be limited to these.

The melting temperature of the release agent is desirably 50° C. or higher, and more preferably 60° C. or higher, from the viewpoint of storage stability. Furthermore, from the viewpoint of offset resistance, the melting temperature is desirably 110° C. or lower, and more preferably 100° C. or lower.

The content of the release agent is desirably from 1% by mass to 15% by mass, more preferably from 2% by mass to 12% by mass, and even more preferably 3% by mass to 10% by mass.

Other additives will be described.

Examples of other internal additives include a magnetic substance, a charge control agent, and an inorganic powder.

The characteristics of the toner particles will be described.

The toner particles may have a single layer structure, or may have a structure composed of a core section and a coating layer that coats the core section (so-called core/shell structure).

The volume average particle size of the toner particles is, for example, from 2 μm to 15 μm, and preferably from 3 μm to 10 μm.

As a method for measuring the volume average particle size of the toner particles, a measurement sample is added to 2 ml of a 5 by mass % aqueous solution of a surfactant as a dispersant, desirably sodium alkylbenzenesulfonate, in an amount of from 0.5 mg to 50 mg, and this mixture is added to from 100 ml to 150 ml of an electrolyte liquid. This electrolyte liquid in which the measurement sample is suspended, is subjected to a dispersion treatment for approximately 1 minute with an ultrasonic dispersing machine, and the particle size distribution of particles having a particle size in the range of from 2.0 μm to 60 μm is measured using a Coulter Multisizer II type (manufactured by Beckman Coulter, Inc.), with an aperture having an aperture diameter of 100 μm. The number of particles to be measured is set to 50,000.

A volume cumulative distribution is produced, starting from the small particle size side, with respect to the particle size ranges (channels) resulting from partition of the particle size distribution thus obtained, and the particle size at a cumulative percentage of 50% is designated as the volume average particle size D50v.

External additives will be described.

Examples of the external additives include inorganic particles, and specific examples include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Particularly, it is favorable to apply at least two kinds of metal oxide particles (for example, silica, titanium oxide, and metatitanic acid) having different volume average particle sizes as the external additives, and specifically, for example, it is favorable to apply at least two kinds of metal oxide particles, such as small-sized metal oxide particles (for example, silica, titanium oxide, and metatitanic acid) having a volume average particle size of from 5 nm to 40 nm (preferably from 8 nm to 20 nm) together with large-sized metal oxide particles (for example, monodisperse spherical silica) having a volume average particle size of from 60 nm to 300 nm (preferably from 80 nm to 200 nm).

When at least two kinds of metal oxide particles having different volume average particle sizes are applied as the external additives, the smaller-sized metal oxide particles (for example, small-sized metal oxide particles having a volume average particle size of from 5 nm to 20 nm) are apt to be localized in the recesses of the surface unevenness of the toner particles. However, when the larger-sized metal oxide particles (for example, large-sized metal oxide particles having a volume average particle size of from 80 nm to 300 nm) are made to adhere to the recesses of the surface unevenness of the toner particles, the smaller-sized metal oxide particles can easily adhere to the surface of the toner particles more uniformly, without being localized.

As a result, the metal oxide particles as the external additives are likely to be in a state of being uniformly attached throughout the toner particle surfaces.

In addition, it is favorable to first perform an external additive treatment of the toner particles with larger-sized metal oxide particles (for example, large-sized metal oxide particles having a volume average particle size of from 80 nm to 300 nm), prior to a treatment with smaller-sized metal oxide particles (for example, small-sized metal oxide particles having a volume average particle size of from 5 nm to 20 nm).

Here, as described above, it is thought that the occurrence of image peeling or cracking between fixed images of different colors, is caused by different rates of contraction of the binder resins of thermally expanded toners, because the piling of the toner layers varies in the fixed images of different colors. That is, it is thought that since the thickness of the toner layer that constitutes a fixed image is different from one color to another, the heat quantity also varies.

On the other hand, if the metal oxide particles as the external additives are in a state of being attached uniformly throughout the toner particle surfaces, the external additives can be present more uniformly also in the interior of the fixed images obtained by the relevant toner.

Furthermore, these metal oxide particles that are in a state of being uniformly dispersed in the interior of the fixed images have a lower thermal conductivity than that of the resin, so that the metal oxide particles function as a thermally conductive material, and transfer heat to a fixed image having a lower heat quantity, between those fixed images of different colors having different heat quantities.

Specifically, for example, a heat quantity is transferred from a fixed image composed of three toner layers with a large heat quantity, to a fixed image composed of two toner layers, or from a fixed image composed of three or two toner layers, to a fixed image composed of a single toner layer. That is, cooling of a fixed image composed of three toner layers, which is most difficult to be cooled, is made easier, while cooling of a fixed image composed of a single toner layer, which is most easily cooled, is made more difficult. As a result, it is thought that the difference in the rate of contraction of the expanded binder resin of the toner between fixed images of different colors is reduced, and stress concentration that occurs between the fixed images of different colors (boundary areas of the images) is relieved. As a result, the occurrence of image peeling or cracking that occurs between fixed images of different colors, is easily suppressed.

From this point of view, it is particularly desirable to apply at least two kinds of metal oxide particles (for example, silica ($SiO_2$) and titanium oxide ($TiO_2$)) having different volume average particle sizes, as the external additives.

The volume average particle size of the external additives (metal oxide particles) is a value measured by using a laser diffraction type particle size distribution analyzer (LA-700: manufactured by Horiba, Ltd.).

In regard to the measurement method, specifically, a sample that is in the form of a dispersion liquid is adjusted such that the solids content reaches approximately 2 g, and ion-exchanged water is added to the sample to adjust the volume to approximately 40 ml. This dispersion liquid is introduced into a cell to an appropriate concentration, and the sample is left to stand for approximately 2 minutes. When the concentration inside the cell is almost stabilized, the measurement is made. The volume average particle size for each of the channels thus obtained is accumulated from the smaller volume average particle size side, and the value at cumulative 50% is defined as the volume average particle size.

The surface of the external additives may be subjected to a hydrophobization treatment in advance. The hydrophobization treatment is carried out by, for example, immersing inorganic particles in a hydrophobizing agent. There are no particular limitations on the hydrophobizing agent, but examples include a silane-based coupling agent, a silicone oil, a titanate-based coupling agent, and an aluminum-based coupling agent. These may be used individually, or two or more kinds may be used in combination.

The amount of the hydrophobizing agent is usually, for example, about from 1 part by mass to 10 parts by mass, based on 100 parts by mass of the inorganic particles.

The amount of external addition of the external additives may be, for example, from 0.5 part by mass to 2.5 parts by mass based on 100 parts by mass of the toner particles.

The method for producing the toner according to the exemplary embodiment of the invention will be described.

First, the toner particles may be produced by any of dry production methods (for example, a kneading pulverizing method) and wet production methods (for example, an aggregation coalescence method, a suspension polymerization method, a solution suspension granulation method, a solution suspension method, or a solution emulsion aggregation coalescence method). There are no particular limitations on these production methods, and a well-known production method is employed.

When the toner particles are produced by an aggregation coalescence method, for example, a dispersion liquid containing the particles of a binder resin, and if necessary, a dispersion liquid containing the particles of a colorant and a dispersion liquid containing the particles of a release agent are provided, and these dispersion liquids are mixed. Thereby, the respective particles are aggregated, and thus, a dispersion liquid in which aggregated particles are dispersed is prepared. Subsequently, these aggregated particles are heated to, for example, a temperature equal to or higher than the glass transition temperature of the binder resin, and the aggregated particles are fused and coalesced. Thus, toner particles are obtained.

Furthermore, when toner particles having a core/shell structure are produced by an aggregation coalescence method, for example, a dispersion liquid containing the particles of a binder resin, and if necessary, a dispersion liquid containing the particles of a colorant and a dispersion liquid containing the particles of a release agent are provided, and these dispersion liquids are mixed. Thereby, the respective particles are aggregated, and thus, a dispersion liquid in which the aggregated particles are dispersed is prepared. Subsequently, the dispersion liquid containing the particles of a binder resin is mixed with the dispersion liquid in which the aggregated particles are dispersed, and the respective particles are attached to the surfaces of the aggregated particles. Subsequently, these aggregated particles are heated to, for example, a temperature equal to or higher than the glass transition temperature of the binder resin, and the aggregated particles to which the respective particles are attached to the surfaces thereof, are fused and coalesced. Thus, toner particles are obtained.

The toners according to the exemplary embodiment of the invention are prepared by, for example, adding external additives to the toner particles thus obtained, and mixing the toner particles with the external additives. Mixing may be carried out using, for example, a V-blender, a Henschel mixer, or a Redige mixer. Furthermore, if necessary, coarse particles of the toner may be eliminated by using a vibration pulverizer, a wind pulverizer, or the like.

(Developer Set for Electrostatic Image Development)

The developer set for electrostatic image development according to the exemplary embodiment of the invention includes developers of various colors respectively containing the respective toners of the toner set according to the exemplary embodiment.

The developers of various colors may be single-component developers containing only a toner, or may be two-component developers containing the toner and a carrier in a mixture.

There are no particular limitations on the carrier, and known carriers may be used. Examples of the carrier include a resin-coated carrier, a magnetic dispersed carrier, and a resin dispersed carrier.

The mixing ratio (mass ratio) of the toner and the carrier in the two-component developer is desirably such that the ratio of toner:carrier is in the range of about 1:100 to 30:100, and more desirably in the range of about 3:100 to 20:100.

(Image Forming Apparatus, Process Cartridge Set, and the Like)

Next, the image forming apparatus according to the exemplary embodiment of the invention will be described.

The image forming apparatus according to the exemplary embodiment includes an image holding member; a charging unit that charges the image holding member; an electrostatic image forming unit that forms an electrostatic image on the charged image holding member; a developing unit that accommodates the respective electrostatic image developers of the developer set for electrostatic image development according to the exemplary embodiment of the invention, and develops an electrostatic image formed on an image holding member into toner images of the respective colors using the respective electrostatic image developers; a transfer unit that transfers the toner image formed on the image holding member onto a medium to be transferred; and a fixing unit that fixes the toner image transferred onto the medium to be transferred.

A method of forming an image using the image forming apparatus according to the exemplary embodiment of the invention includes charging the image holding member; forming an electrostatic image on the charged image holding member; developing the electrostatic image formed on the image holding member into toner images of the respective colors, using the respective electrostatic image developers of the developer set for electrostatic image development according to the exemplary embodiment of the invention; transferring the toner images formed on the image holding member onto a medium to be transferred; and fixing the toner images transferred onto the medium to be transferred.

The image forming apparatus according to the exemplary embodiment of the invention includes a toner image forming unit for each color, which forms a toner image for each color on the medium to be transferred, using each of the electrostatic image developers of the developer set for electrostatic image development according to the exemplary embodiment of the invention.

That is, as the toner image forming unit for each color, the image forming apparatus includes, for example, an image holding member; a charging unit that charges the surface of the image holding member; an electrostatic image forming unit that forms an electrostatic image on the charged image holding member; a developing unit that develops the electrostatic image into a toner image formed on the image holding member using a developer (toner); a transfer unit that transfers the toner image formed on the image holding member, onto a medium to be transferred; and if necessary, other units such as a cleaning unit that cleans the transfer residual components of the image holding member, and also includes a fixing unit that fixes the toner images (toner images of various colors) transferred onto a medium to be transferred. Of course, the toner image forming units for the respective colors may have a constitution which share, for example, the image holding member or the transfer unit.

In the image forming apparatus according to the exemplary embodiment of the invention, the fixing unit may include a pair of rotating members which have a transfer medium nipped therebetween and performing fixing, and which are disposed to be in contact with each other such that the width of the contact area (nip width) is from 3 mm to 10 mm, with the fixing time set to a period of from 10 ms to 40 ms. Here, the fixing time means the time taken by a medium to be transferred (paper) to pass through the contact area of a pair of rolls. More specifically, when the width of the contact area is, for example, 6 mm, and the rate of passage of the paper is 180 mm/sec, the time for passage is 6÷180=0.0333 seconds, that is, 33.3 milliseconds (ms) is the fixing time.

Specifically, the fixing unit may include, for example, a heating member and a pressing member as the pair of rotating members, and these members may be belt members or roll members.

That is, the fixing unit may be any system (former: in the shape of a heating member, latter: in the shape of a pressing member) of a roll-roll system, a roll-belt system, or a belt-roll system.

An image forming apparatus that includes this fixing unit is an apparatus that is classified as a so-called high-speed machine, and as described above, is an image forming apparatus by which a toner image is not easily subjected to heat or pressure during fixing, and the paper (medium to be transferred) after fixing can be piled in a short time, so that the time for a fixed image to be brought into contact with air (cooling time) is short. However, when the developer set for electrostatic image development according to the exemplary embodiment of the invention is applied, the occurrence of image peeling or cracking that occurs between fixed images of different colors, is suppressed more satisfactorily.

Here, in the image forming apparatus according to the exemplary embodiment of the invention, for example, the portion including the developing unit which accommodates the respective electrostatic image developers of the developer set for electrostatic image development according to the exemplary embodiment of the invention may have a cartridge structure (process cartridge set) that is detachable from the image forming apparatus, or the portion which accommodates the respective toners of the toner set according to the exemplary embodiment of the invention as supplementary toners that are supplied to the developing unit, may have a cartridge structure (toner cartridge set) that is detachable from the image forming apparatus.

The image forming apparatus according to the exemplary embodiment of the invention may be, for example, an image forming apparatus that sequentially repeats primary transfer of toner images of various colors retained on the image holding member, to an intermediate transfer medium, or may be a tandem type image forming apparatus in which plural image holding members equipped with a developing unit for each color are disposed in series on an intermediate transfer medium.

Hereinafter, the image forming apparatus according to the exemplary embodiment of the invention will be described with reference to the attached drawings.

FIG. 1 is a schematic constitutional diagram showing an example of the image forming apparatus according to the exemplary embodiment of the invention. The image forming apparatus according to the exemplary embodiment of the invention relates to the tandem type constitution in which plural photoreceptors, that is, plural image forming units are installed as the image holding members.

In addition, an image forming apparatus including three image forming units that form the respective toner images of yellow, magenta and cyan colors will be described, but the invention is not intended to be limited thereto, and the image forming apparatus may be an image forming apparatus including image forming units that form toner images of black color, or toner images of other intermediate colors.

The image forming apparatus according to the exemplary embodiment of the invention is such that, as shown in FIG. 1, three image forming units, 50Y, 50M and 50C, that form the respective toner images of yellow, magenta and cyan colors are disposed in parallel (in a tandem mode) at an interval. The respective image forming units are arranged in the order of the image forming units 50Y, 50M and 50C from the downstream side of the rotational direction of the intermediate transfer belt 33.

Here, since the respective image forming units 50Y, 50M and 50C have an identical constitution except for the color of the toner in the developer accommodated in each unit, an explanation will be given herein on the image forming unit 50Y that forms yellow images as a representative. Furthermore, reference symbols indicating magenta (M) and cyan (C) will be assigned, in place of yellow (Y), to the same parts as those of the image forming unit 50Y, and descriptions on the image forming units 50M and 50C will not be repeated.

The yellow image forming unit 50Y includes a photoreceptor 11Y as an image holding member, and this photoreceptor 11Y is made to be rotationally driven at a predetermined process speed by a driving unit (not depicted) along the direction of the arrow A shown in the diagram. As the photoreceptor 11Y, for example, an organic photoreceptor having sensitivity in the infrared region is used.

A charging roll (charging unit) 18Y is provided in the upper area of the photoreceptor 11Y, and a predetermined voltage is applied to the charging roll 18Y by a power supply that is not depicted, and the surface of the photoreceptor 11Y is charged with a predetermined potential.

In the periphery of the photoreceptor 11Y, an exposure apparatus (electrostatic image forming unit) 19Y that exposes the surface of the photoreceptor 11Y and forms an electrostatic image, is disposed on the further downstream side of the rotational direction of the photoreceptor 11Y than the charging roll 18Y. In addition, an LED array which is capable of miniaturization is used herein as the exposure apparatus 19Y from the viewpoint of an efficient use of space; however, the exposure apparatus is not limited to this, and other electrostatic image forming units utilizing a laser beam or the like may also be favorably used.

In the periphery of the photoreceptor 11Y, a developing apparatus (developing unit) 20Y which includes a developer holding member that holds a developer for yellow color is disposed on the further downstream side of the rotational direction of the photoreceptor 11Y than the exposure apparatus 19Y. The developing apparatus 20Y has a constitution of developing the electrostatic image formed on the surface of the photoreceptor 11Y, using a toner of yellow color, and forming a toner image on the surface of the photoreceptor 11Y.

In the lower part of the photoreceptor 11Y, an intermediate transfer belt (primary transfer unit) 33 which performs primary transfer of the toner image formed on the surface of the photoreceptor 11Y is disposed across the lower part of the three photoreceptors 11Y, 11M and 11C. This intermediate transfer belt 33 is pressed against the surface of the photoreceptor 11Y by a primary transfer roll 17Y. Furthermore, the intermediate transfer belt 33 is stretched by three rolls such as a driving roll 12, a supporting roll 13, and a bias roll 14, and is made to circumferentially move in the direction of the arrow B at a movement rate equal to the process speed of the photoreceptor 11Y. A yellow toner image is primary transferred onto the surface of the intermediate transfer belt 33, and the respective toner images of magenta and cyan colors are further primary transferred thereon in sequence and are laminated.

Furthermore, in the periphery of the photoreceptor 11Y, a cleaning apparatus 15Y intended for cleaning of any residual toner or retransferred toner on the surface of the photoreceptor 11Y is disposed on the further downstream side of the rotational direction (direction of the arrow A) of the photoreceptor 11Y than the primary transfer roll 17Y. The cleaning blade in the cleaning apparatus 15Y is mounted so as to be in contact under pressure with the surface of the photoreceptor 11Y in the counter direction.

While tension is exerted on the intermediate transfer belt 33, a secondary transfer roll (secondary transfer unit) 34 is in contact under pressure with the supporting bias roll 14, with the intermediate transfer belt 33 interposed therebetween. The toner images that have been primary transferred and laminated on the surface of the intermediate transfer belt 33 are electrostatically transferred onto the surface of a recording paper (medium to be transferred) P that is supplied from a paper cassette (not depicted), at the pressure contact area between the bias roll 14 and the secondary transfer roll 34.

A fixing machine (fixing unit) 35 intended for fixing the toner images that are multiple transferred on the recording paper P to the surface of the recording paper P under heat and pressure, to make the toner images into a permanent image, is located downstream of the secondary transfer roll 34.

Examples of the fixing machine 35 include a fixing belt which has a belt shape and a cylindrically shaped fixing roll by using a low-surface energy material represented by a fluororesin component or a silicone-based resin, on each surface.

Next, the operations of the respective image forming units 50Y, 50M and 50C that form the respective images of yellow, magenta and cyan colors, will be described. Since the operations of the respective image forming units 50Y, 50M and 50C are the same in the respective units, the operation of the image forming unit 50Y for yellow color will be described as a representative case.

In the developing unit 50Y for yellow color, the photoreceptor 11Y rotates in the direction of the arrow A at a predetermined process speed. The surface of the photoreceptor 11Y is negatively charged by the charging roll 18Y, to a predetermined electric potential. The surface of the photoreceptor 11Y is then exposed by the exposure apparatus 19Y, and thereby an electrostatic image is formed in accordance with the image information. Subsequently, a toner that has been negatively charged by the developing apparatus 20Y is reverse developed, and the electrostatic image formed on the surface of the photoreceptor 11Y is converted into a visual image at the surface of the photoreceptor 11Y, so that a toner image is formed. Subsequently, the toner image on the surface of the photoreceptor 11Y is primary transferred onto the surface of the intermediate transfer belt 33 by the primary transfer roll 17Y. After the primary transfer, the photoreceptor 11Y is treated such that transfer remnant components such as residual toner on the surface of the photoreceptor 11Y are scraped off and cleaned by the cleaning blade of the cleaning apparatus 15Y, and the photoreceptor 11Y is supplied to the next image forming step.

The operation as described above is carried out for the respective image forming units 50Y, 50M and 50C, and the toner images that have been made visible on the respective surfaces of the photoreceptors 11Y, 11M and 11C are sequentially multiple transferred onto the surface of the intermediate transfer belt 33. In the color mode, the respective toner images of different colors are multiple transferred in the order of yellow, magenta and cyan, and also in the bicolor mode and tricolor mode, only those toner images of necessary colors are single transferred or multiple transferred in this order.

Thereafter, the toner images that have been single transferred or multiple transferred onto the surface of the intermediate transfer belt 33, are secondary transferred onto the surface of the recording paper P that has been conveyed from a paper accommodating container (not depicted), by the secondary transfer roll 34, and the toner images are subsequently fixed by being heated and pressed in the fixing machine 35. Any toner remaining on the surface of the intermediate transfer belt 33 after the secondary transfer is cleaned by a belt cleaner 16 composed of a cleaning blade for the intermediate transfer belt 33.

The yellow image forming unit 50Y is constructed as a process cartridge in which the developing apparatus 20Y which includes a developer holding member that holds the electrostatic image developer for yellow color, the photoreceptor 11Y, the charging roll 18Y, and the cleaning apparatus 15Y are integrated, and which is detachable from the main body of the image forming apparatus. Furthermore, the image forming units 50C and 50M are also constructed as process cartridges, as in the case of the image forming unit 50Y.

The toner cartridges 40Y, 40M and 40C are cartridges which hold the toners of the respective colors, and are detachable from the image forming apparatus. Each toner cartridge is connected to the corresponding developing apparatus for each color, via a toner supply pipe that is not depicted in the diagram. When the amount of the toner received in each toner cartridge decreases, a replacement of this toner cartridge is made.

EXAMPLES

Hereinafter, the invention will be described in more detail based on Examples, but the invention is not intended to be limited to the following Examples. Unless particularly stated otherwise, the unit "parts" means "parts by mass."

[Synthesis of Polyester Resin]

—Synthesis of Polyester Resin (1)—

In a heated and dried two-necked flask, 80 molar parts of polyoxypropylene (2,2)-2,2-bis(4-hydroxyphenyl)propane, 10 molar parts of ethylene glycol, 10 molar parts of cyclohexanediol, 80 molar parts of terephthalic acid, 10 molar parts of isophthalic acid, and 10 molar parts of n-dodecenylsuccinic acid are put as raw materials, and dibutyltin oxide is added as a catalyst. Nitrogen gas is introduced into the container to maintain an inert atmosphere, and the temperature is raised. Subsequently, a copolycondensation reaction is carried out for about 12 hours at a temperature of 150° C. to 230° C. Subsequently, the pressure is slowly decreased at a temperature of 210° C. to 250° C., and thus a polyester resin (1) is synthesized.

The weight average molecular weight (Mw) of the polyester resin (1) thus obtained is 17,200. The acid value of the polyester resin (1) is 12.4 mg KOH/g.

Furthermore, the glass transition temperature of the polyester resin (1) is measured using a differential scanning calorimeter (DSC), and the value is obtained by an analysis according to the JIS standards (see JIS K-7121).

As a result, no clear peak is observed, and a stepwise change in the heat absorption is observed. The glass transition temperature (Tg) taken from the midpoint of the stepwise change in the heat absorption, is 59° C.

[Preparation of Polyester Resin Dispersion Liquid]

| - Preparation of polyester resin dispersion liquid (A1) - | |
|---|---|
| Polyester resin (1) | 100 parts by mass |
| Ethyl acetate | 70 parts by mass |
| Isopropyl alcohol | 15 parts by mass |

A mixed solvent of the ethyl acetate and isopropyl alcohol as shown above is introduced into a 5-L separable flask, and the resin is slowly introduced into this mixed solvent. The mixture is stirred with a three-one motor to dissolve the resin, and thus an oil phase is obtained.

A 10 mass % aqueous ammonia solution is slowly added dropwise with a dropper into the oil phase that is being stirred, such that the total amount of the aqueous ammonia solution would be 3.5 parts by mass. Furthermore, 230 parts by mass of ion-exchanged water is slowly added dropwise to the mixture at a rate of 10 ml/min, to induce reverse-phase emulsification. The solvent is removed under reduced pressure in an evaporator, and thus a "polyester resin dispersion liquid (A1)" containing the "polyester resin (1)" is obtained. The volume average particle size of the resin particles dispersed in this dispersion liquid is 182 nm. The resin particle concentration of the dispersion liquid is adjusted to 20 mass % with ion-exchanged water.

—Synthesis of Polyester Resin (2) and Preparation of Polyester Resin Dispersion Liquid (A2)—

A polyester resin (2) is synthesized in the same manner as in the synthesis of the polyester resin (1), except that the components used for the polyester resin (1) are changed to 70 molar parts of polyoxypropylene (2,2)-2,2-bis(4-hydroxyphenyl)propane, 20 molar parts of ethylene glycol, 75 molar parts of terephthalic acid, and 15 molar parts of n-dodecenylsuccinic acid. The weight average molecular weight (Mw) is 16,100, and the glass transition temperature (Tg) is 54° C.

A polyester resin dispersion liquid (A2) is prepared in the same manner as in the preparation of the polyester resin dispersion liquid (A1).

—Synthesis of Polyester Resin (3) and Preparation of Polyester Resin Dispersion Liquid (A3)—

A polyester resin (3) is synthesized in the same manner as in the synthesis of the polyester resin (1), except that the amount of terephthalic acid is changed to 78 molar parts, and 2 parts of trimellitic anhydride is added. The weight average molecular weight (Mw) is 17,500, and the glass transition temperature (Tg) is 59° C.

A polyester resin dispersion liquid (A3) is prepared in the same manner as in the preparation of the polyester resin dispersion liquid (A1).

—Synthesis of Polyester Resin (4) and Preparation of Polyester Resin Dispersion Liquid (A4)—

A polyester resin (4) is synthesized in the same manner as in the synthesis of the polyester resin (1), except that the components used for the polyester resin (1) are changed to 70 molar parts of polyoxypropylene (2,2)-2,2-bis(4-hydroxyphenyl)propane, 20 molar parts of ethylene glycol, 60 molar parts of terephthalic acid, and 30 molar parts of n-dodecenylsuccinic acid. The weight average molecular weight (Mw) is 15,000, and the glass transition temperature (Tg) is 51° C.

A polyester resin dispersion liquid (A4) is prepared in the same manner as in the preparation of the polyester resin

[Preparation of Colorant Dispersion Liquid]

| - Preparation of colorant dispersion liquid (B1) - | |
|---|---|
| Cyan pigment (manufactured by Dainichiseika Color & Chemicals Manufacturing Co., Ltd., Pigment Blue 15:1 (copper phthalocyanine)) | 1000 parts |
| Anionic surfactant (manufactured by Dai-ichi Kogyo Seiyaku Co., Ltd., NEOGEN R) | 15 parts |
| Ion-exchanged water | 9000 parts |

These components are mixed and dissolved, and the mixture is dispersed for about one hour using a high pressure impact type dispersing machine, Ultimizer (manufactured by Sugino Machine, Ltd., HJP30006). Thus, a colorant dispersion liquid having a colorant (pigment) dispersed therein, is prepared. The volume average particle size of the colorant (pigment) particles in the colorant dispersion liquid is 0.16 μm, and the solids concentration is 20%.

—Preparation of Colorant Dispersion Liquids (B2) to (B5)—

The respective colorant dispersion liquids are obtained in the same manner as in the preparation of the colorant dispersion liquid (B1), except that the type of the colorant (pigment) is changed as indicated in Table 1.

TABLE 1

| Colorant dispersion liquid No. | Colorant (pigment) | Color |
|---|---|---|
| B1 | B15:1 (Phthalocyanine) | Cyan |
| B2 | Y17 (Azo) | Yellow |
| B3 | Y110 (Isoindolinone) | Yellow |
| B4 | R122 (Quinacridone) | Magenta |
| B5 | R57:1 (Azo) | Magenta |

In the Table 1, the details of the colorant (pigment) are as follows.

B15:1=Cyan pigment (manufactured by Dainichiseika Color & Chemicals Manufacturing Co., Ltd., C.I. Pigment Blue 15:1 (copper phthalocyanine))

Y17=Yellow pigment (manufactured by Dainichiseika Color & Chemicals Manufacturing Co., Ltd., SEIKA FAST YELLOW 2400(B) (Disazo Yellow: pigment having an azo group), C.I. Pigment Yellow 17)

Y110=Yellow pigment (manufactured by BASF Corp., CROMOPHTAL YELLOW 2RLP (isoindolinone), C.I. Pigment Yellow 110)

R122=Magenta pigment (manufactured by Dainichiseika Color & Chemicals Manufacturing Co., Ltd., CHROMOFINE MAGENTA 6887 (quinacridone), C.I. Pigment Red 122)

R57:1=Magenta pigment (manufactured by Dainichiseika Color & Chemicals Manufacturing Co., Ltd., SEIKA FAST CARMINE 1476T-7 (pigment having an azo group) C.I. Pigment Red 57:1)

[Preparation of Release Agent Dispersion Liquid]

—Preparation of Release Agent Dispersion Liquid (C1)—

Paraffin wax (manufactured by Nippon Seiro Co., Ltd., HNP-9, melting temperature: 75° C.): 50 parts Anionic surfactant (manufactured by Dai-ichi Kogyo Seiyaku Co., Ltd., NEOGEN RK): 0.5 part Ion-exchanged water: 200 parts These components are mixed and heated to 95° C., and the mixture is dispersed using a homogenizer (manufactured by IKA Laboratories, Ltd., ULTRA-TURRAX T50). Subsequently, the dispersion is subjected to a dispersion treatment with a Manton Gaulin high pressure homogenizer (Gaulin Corp.), and thus a release agent dispersion liquid in which a release agent is dispersed (solids concentration: 20%) is prepared. The volume average particle size of the release agent particles is 0.23 μm.

—Preparation of Release Agent Dispersion Liquid (C2)—

Polyethylene wax (manufactured by Baker Petrolite Corp., POLYWAX 655, melting temperature: 93° C.): 50 parts Anionic surfactant (manufactured by Dai-ichi Kogyo Seiyaku Co., Ltd., NEOGEN RK): 0.5 part Ion-exchanged water: 200 parts These components are mixed and heated to 95° C., and the mixture is dispersed using a homogenizer (manufactured by IKA Laboratories, Ltd., ULTRA-TURRAX T50). Subsequently, the dispersion is subjected to a dispersion treatment with a Manton Gaulin high pressure homogenizer (Gaulin Corp.), and thus a release agent dispersion liquid in which a release agent is dispersed (solids concentration: 20%) is prepared. The volume average particle size of the release agent particles is 0.28 μm.

—Preparation of Release Agent Dispersion Liquid (C3)—

Polyethylene wax (manufactured by Clariant Corp., PE130, melting temperature: 125° C.): 50 parts Anionic surfactant (manufactured by Dai-ichi Kogyo Seiyaku Co., Ltd., NEOGEN RK): 0.5 part Ion-exchanged water: 200 parts These components are mixed and heated to 95° C., and the mixture is dispersed using a homogenizer (manufactured by IKA Laboratories, Ltd., ULTRA-TURRAX T50). Subsequently, the dispersion is subjected to a dispersion treatment with a Manton Gaulin high pressure homogenizer (Gaulin Corp.), and thus a release agent dispersion liquid in which a release agent is dispersed (solids concentration: 20%) is prepared. The volume average particle size of the release agent particles is 0.27 μm.

—Preparation of Release Agent Dispersion Liquid (C4)—

Polypropylene wax (manufactured by Mitsui Chemicals, Inc., P200, melting temperature: 145° C.): 50 parts Anionic surfactant (manufactured by Dai-ichi Kogyo Seiyaku Co., Ltd., NEOGEN RK): 0.5 part Ion-exchanged water: 200 parts These components are mixed and heated to 95° C., and the mixture is dispersed using a homogenizer (manufactured by IKA Laboratories, Ltd., ULTRA-TURRAX T50). Subsequently, the dispersion is subjected to a dispersion treatment with a Manton Gaulin high pressure homogenizer (Gaulin Corp.), and thus a release agent dispersion liquid in which a release agent is dispersed (solids concentration: 20%) is prepared. The volume average particle size of the release agent particles is 0.29 μm.

—Preparation of Release Agent Dispersion Liquid (C5)—

Behenic acid ester wax (manufactured by Riken Vitamin Co., Ltd., EW861, melting temperature: 60° C.): 50 parts Anionic surfactant (manufactured by Dai-ichi Kogyo Seiyaku Co., Ltd., NEOGEN RK): 0.5 part Ion-exchanged water: 200 parts These components are mixed and heated to 95° C., and the mixture is dispersed using a homogenizer (manufactured by IKA Laboratories, Ltd., ULTRA-TURRAX T50). Subsequently, the dispersion is subjected to a dispersion treatment with a Manton Gaulin high pressure homogenizer (Gaulin Corp.), and thus a release agent dispersion liquid in which a release agent is dispersed (solids concentration: 20%) is prepared. The volume average particle size of the release agent particles is 0.21 μm.

TABLE 2

| Release agent dispersion liquid No. | Release agent (WAX) | Melting temperature (° C.) |
|---|---|---|
| C1 | HNP-9 (Paraffin wax) | 75 |
| C2 | POLYWAX655 (Polyethylene wax) | 93 |
| C3 | PE130 (Polyethylene wax) | 125 |
| C4 | P200 (Polypropylene wax) | 145 |
| C5 | EW861 (Behenic acid ester wax) | 60 |

In Table 2, the details of the release agent (wax) are as follows.

HNP-9=Paraffin wax (manufactured by Nippon Seiro Co., Ltd.)

POLYWAX655=Polyethylene wax (manufactured by Baker Petrolite Corp.)

PE130=Polyethylene wax (manufactured by Clariant Corp.)

P200=Polypropylene wax (manufactured by Mitsui Chemicals, Inc.)

EW861=Behenic acid ester wax (manufactured by Riken Vitamin Co., Ltd.)

[Production of Cyan Toners]

| - Production of cyan toner 1 - | |
|---|---|
| Polyester resin dispersion liquid (A1) | 320 parts |
| Colorant dispersion liquid (B1) | 25 parts |
| Release agent dispersion liquid (C1) | 40 parts |
| Anionic surfactant (Teyca Power) | 2.0 parts |

The raw materials described above are introduced into a 2-L cylindrical stainless steel container, and the raw materials are mixed by dispersing the raw materials for 10 minutes using a homogenizer (manufactured by IKA Laboratories, Ltd., Ultra-Turrax T50), with the speed of rotation of the homogenizer set at 4000 rpm, while a shear force is applied. Subsequently, 1.75 parts of a 10% nitric acid-aqueous solution of polyaluminum chloride is slowly added dropwise to the mixture as an aggregating agent. The resulting mixture is mixed by dispersing the mixture, with the speed of rotation of the homogenizer set at 5000 rpm, and thus a raw material dispersion liquid is obtained.

Thereafter, the raw material dispersion liquid is transferred to a polymerization pot equipped with a stirring apparatus and a thermometer, heating of the raw material dispersion liquid on a mantle heater is started, and thereby the growth of aggregated particles is accelerated at 42° C. At this time, the pH of the raw material dispersion liquid is adjusted in the range of from 3.2 to 3.8, by using 0.3 N nitric acid or a 1 N aqueous solution of sodium hydroxide. The raw material dispersion liquid is left to stand for about 2 hours while the pH is maintained in the range described above, and thus aggregated particles are formed. The volume average particle size of these aggregated particles is 5.4 μm.

Subsequently, 115 parts of the polyester resin dispersion liquid (A1) is additionally added to the raw material dispersion liquid, and thus the resin particles of the polyester resin (1) are attached to the surface of the aggregated particles. Furthermore, the raw material dispersion liquid is heated to 44° C., and the aggregated particles are conditioned, while examining the size and shape of the particles using an optical microscope and a Multisizer-II. Subsequently, in order to coalsce the aggregated particles, an aqueous solution of NaOH is added dropwise to the raw material dispersion liquid to adjust the pH to 7.5, and then the raw material dispersion liquid is heated to 95° C. Thereafter, the raw material dispersion liquid is left to stand for 3 hours, and thereby the aggregated particles are coalesced. It is confirmed with an optical microscope that the aggregated particles are coalesced, and then the raw material dispersion liquid is cooled at a rate of temperature decrease of 1.0° C./min.

In the raw material dispersion liquid thus obtained, colored resin particles are formed.

Next, the raw material dispersion liquid is filtered, and the colored resin particles obtained after solid-liquid separation are washed with water by dispersing the colored resin particles in ion-exchanged water at 30° C. in an a 20-fold amount relative to the colored resin particle solids content.

This water washing is repeated 10 times, and then the colored resin particles are dried and classified by cyclone collection using a loop type air stream dryer. Thus, cyan toner particles are obtained.

1.5 parts of monodisperse spherical sol-gel silica (volume average particle size 140 nm, HMDS-treated) is externally added to 100 parts of the cyan toner particles thus obtained, by adding the silica and blending the components for 20 minutes using a 20-L Henschel mixer at a peripheral speed of the stirring blade tip of 10 m/s. Furthermore, 1.3 parts of titanium oxide particles (volume average particle size of 20 nm) is externally added to the cyan toner particles by adding the titanium oxide particles, and blending the mixture for 15 minutes using a 20-L Henschel mixer at a peripheral speed of the stirring blade of 55 m/s.

Subsequently, coarse particles are removed by using a mesh sieve having a pore size of 45 μm, and thus a cyan toner 1 is produced.

—Production of Cyan Toner 2—

A cyan toner 2 is produced in the same manner as in the production of the cyan toner 1, except that 4 parts of the release agent dispersion liquid (C1) and 36 parts of the release agent dispersion liquid (C5) are used.

—Production of Cyan Toner 3—

A cyan toner 3 is produced in the same manner as in the production of the cyan toner 1, except that the release agent dispersion liquid (C1) is replaced with the release agent dispersion liquid (C2).

—Production of Cyan Toner 4—

A cyan toner 4 is produced in the same manner as in the production of the cyan toner 1, except that the release agent dispersion liquid (C1) is replaced with the release agent dispersion liquid (C5).

—Production of Cyan Toner 5—

A cyan toner 5 is produced in the same manner as in the production of the cyan toner 1, except that the polyester resin dispersion liquid (A1) is replaced with the polyester resin dispersion liquid (A2). Furthermore, the polyester resin dispersion liquid that is additionally added is also the polyester resin dispersion liquid (A2).

—Production of Cyan Toner 6—

A cyan toner 6 is produced in the same manner as in the production of the cyan toner 1, except that 36 parts of the release agent dispersion liquid (C2) and 4 parts of the release agent dispersion liquid (C3) are used instead of the release agent dispersion liquid (C1).

—Production of Cyan Toner 7—

A cyan toner 7 is produced in the same manner as in the production of the cyan toner 1, except that the polyester resin dispersion liquid (A1) is replaced with the polyester resin dispersion liquid (A3). Furthermore, the polyester resin dispersion liquid that is additionally added is also the polyester resin dispersion liquid (A3).

—Production of Cyan Toner 8—

A cyan toner 8 is produced in the same manner as in the production of the cyan toner 1, except that the polyester resin dispersion liquid (A1) is replaced with the polyester resin dispersion liquid (A4). Furthermore, the polyester resin dispersion liquid that is additionally added is also the polyester resin dispersion liquid (A4).

—Production of Cyan Toner 9—

A cyan toner 9 is produced in the same manner as in the production of the cyan toner 1, except that 320 parts of the polyester resin dispersion liquid (A1) is replaced with 305 parts of the polyester resin dispersion liquid (A2), 40 parts of the release agent dispersion (C1), and 15 parts of the release agent dispersion liquid (C5).

—Production of Cyan Toner 10—

A cyan toner 10 is produced in the same manner as in the production of the cyan toner 1, except that 320 parts of the polyester resin dispersion liquid (A1) is replaced with 315 parts of the polyester resin dispersion liquid (A3), 40 parts of the release agent dispersion (C1), and 5 parts of the release agent dispersion liquid (C3).

—Production of Cyan Toner 11—

A cyan toner 11 is produced in the same manner as in the production of the cyan toner 1, except that the release agent dispersion liquid (C1) is replaced with the release agent dispersion liquid (C3).

—Production of Cyan Toner 12—

A cyan toner 12 is produced in the same manner as in the production of the cyan toner 1, except that the monodisperse spherical sol-gel silica is not added, and 2 parts of titanium oxide particles (volume average particle size 20 nm) is added.

—Production of Cyan Toner 13—

A cyan toner 13 is produced in the same manner as in the production of the cyan toner 8, except that the monodisperse spherical sol-gel silica is not added, and 2 parts of titanium oxide particles (volume average particle size 20 nm) is added.

—Production of Cyan Toner 14—

A cyan toner 14 is produced in the same manner as in the production of the cyan toner 11, except that the monodisperse spherical sol-gel silica is not added, and 2 parts of titanium oxide particles (volume average particle size 20 nm) is added.

—Production of Cyan Toner 15—

83 parts by mass of the polyester resin (1), 3 parts by mass of the polyester resin (3), 5 parts by mass of the aforementioned cyan pigment (manufactured by Dainichiseika Color & Chemicals Manufacturing Co., Ltd., Pigment Blue 15:1 (copper phthalocyanine)) as a colorant, and 9 parts by mass of paraffin wax (HNP-9) as a release agent are melt kneaded with a Banbury kneader. After cooling, the mixture is crude pulverized, and is further pulverized with a jet micropulverizer. Subsequently, the pulverized particles are classified with an air classifier (Elbow-Jet, EJ-LABO), and thus cyan toner particles having a volume average particle size of 7 μm are produced.

1.5 parts of a monodisperse spherical sol-gel silica (volume average particle size 140 nm, HMDS-treated) is externally added to 100 parts of the cyan toner particles thus obtained, by adding the silica and blending the components for 20 minutes using a 20-L Henschel mixer at a peripheral speed of the stirring blade tip of 10 m/s. Subsequently, 1.3 parts of titanium oxide particles (volume average particle size of 20 nm) is further externally added to the cyan toner particles by adding the titanium oxide particles, and blending the mixture for 15 minutes at a peripheral speed of the stirring blade of 55 m/s.

Subsequently, coarse particles are removed by using a mesh sieve having a pore size of 45 μm, and thus a cyan toner 18 is produced.

—Production of Cyan Toner 16—

A cyan toner 16 is produced in the same manner as in the production of the cyan toner 15, except that the polyester resin (1) is replaced with the polyester resin (4).

—Production of Cyan Toner 17—

A cyan toner 17 is produced in the same manner as in the production of the cyan toner 15, except that the HNP-9 used in the production of the cyan toner 15 is changed to PE130 (polyethylene wax (manufactured by Clariant Corp.)).

[Production of Magenta Toners]

—Production of Magenta Toner 1—

A magenta toner 1 is produced in the same manner as in the production of the cyan toner 1, except that the components are changed to 315 parts of the polyester resin dispersion liquid (A1), 25 parts of the colorant dispersion liquid (B5), 5 parts of the colorant dispersion liquid (B4), and 40 parts of the release agent dispersion liquid (C1).

—Production of Magenta Toner 2—

A magenta toner 2 is produced in the same manner as in the production of the magenta toner 1, except that 4 parts of the release agent dispersion liquid (C1) and 36 parts of the release agent dispersion liquid (C5) are used.

—Production of Magenta Toner 3—

A magenta toner 3 is produced in the same manner as in the production of the magenta toner 1, except that the release agent dispersion liquid (C1) is replaced with the release agent dispersion liquid (C2).

—Production of Magenta Toner 4—

A magenta toner 4 is produced in the same manner as in the production of the magenta toner 1, except that the release agent dispersion liquid (C1) is replaced with the release agent dispersion liquid (C5).

—Production of Magenta Toner 5—

A magenta toner 5 is produced in the same manner as in the production of the magenta toner 1, except that the polyester resin dispersion liquid (A1) is replaced with the polyester resin dispersion liquid (A2). Furthermore, the polyester resin dispersion liquid that is additionally added is also the polyester resin dispersion liquid (A2).

—Production of Magenta Toner 6—

A magenta toner 6 is produced in the same manner as in the production of the magenta toner 1, except that 38 parts of the release agent dispersion liquid (C2) and 2 parts of the release agent dispersion liquid (C3) are used instead of the release agent dispersion liquid (C1).

—Production of Magenta Toner 7—

A magenta toner 7 is produced in the same manner as in the production of the magenta toner 1, except that 340 parts of the polyester resin dispersion liquid (A1) is replaced with 336 parts of the polyester resin dispersion liquid (A3) and 4 parts of the release agent dispersion liquid (C5) are used. Furthermore, the polyester resin dispersion liquid that is additionally added is also the polyester resin dispersion liquid (A3).

—Production of Magenta Toner 8—

A magenta toner 8 is produced in the same manner as in the production of the magenta toner 1, except that the polyester resin dispersion liquid (A1) is replaced with the polyester resin dispersion liquid (A4). Furthermore, the polyester resin dispersion liquid that is additionally added is also the polyester resin dispersion liquid (A4).

—Production of Magenta Toner 9—

A magenta toner 9 is produced in the same manner as in the production of the magenta toner 1, except that 320 parts of the polyester resin dispersion liquid (A1) is replaced with 305 parts of the polyester resin dispersion liquid (A2), 40 parts of the release agent dispersion (C1), and 15 parts of the release agent dispersion liquid (C5).

—Production of Magenta Toner 10—

A magenta toner 10 is produced in the same manner as in the production of the magenta toner 1, except that 320 parts of the polyester resin dispersion liquid (A1) is replaced with 315 parts of the polyester resin dispersion liquid (A3), 40 parts of the release agent dispersion (C1), and 5 parts of the release agent dispersion liquid (C4).

—Production of Magenta Toner 11—

A magenta toner 11 is produced in the same manner as in the production of the magenta toner 1, except that the release agent dispersion liquid (C1) is replaced with the release agent dispersion liquid (C3).

—Production of Magenta Toner 12—

A magenta toner 12 is produced in the same manner as in the production of the magenta toner 1, except that 4 parts of the release agent dispersion liquid (C1) and 36 parts of the release agent dispersion liquid (C5) are used.

—Production of Magenta Toner 13—

A magenta toner 13 is produced in the same manner as in the production of the magenta toner 1, except that the polyester resin dispersion liquid (A1) is replaced with the polyester resin dispersion liquid (A4), the amount of the release agent dispersion liquid (B4) is changed to 30 parts, and the release agent dispersion liquid (B5) is not used. Furthermore, the polyester resin dispersion liquid that is additionally added is also the polyester resin dispersion liquid (A4).

—Production of Magenta Toner 14—

A magenta toner 14 is produced in the same manner as in the production of the magenta toner 13, except that the release agent dispersion liquid (C1) is replaced with the release agent dispersion liquid (C3).

—Production of Magenta Toner 15—

A magenta toner 15 is produced in the same manner as in the production of the magenta toner 1, except that the monodisperse spherical sol-gel silica is not added, and 2 parts of titanium oxide particles (volume average particle size 20 nm) is added.

—Production of Magenta Toner 16—

A magenta toner 16 is produced in the same manner as in the production of the magenta toner 8, except that the monodisperse spherical sol-gel silica is not added, and 2 parts of titanium oxide particles (volume average particle size 20 nm) is added.

—Production of Magenta Toner 17—

A magenta toner 17 is produced in the same manner as in the production of the magenta toner 11, except that the monodisperse spherical sol-gel silica is not added, and 2 parts of titanium oxide particles (volume average particle size 20 nm) is added.

—Production of Magenta Toner 18—

A magenta toner 18 is produced in the same manner as in the production of the cyan toner 15, except that the components are changed to 82 parts by mass of the polyester resin (1), 3 parts of the polyester resin (3), 5 parts of R57:1 (manufactured by Dainichiseika Color & Chemicals Manufacturing Co., Ltd., SEIKA FAST CARMINE 1476T-7) as a colorant, 1 part of R122 (manufactured by Dainichiseika Color & Chemicals Manufacturing Co., Ltd., CHROMOFINE MAGENTA 6887), and 9 parts by mass of paraffin wax (HNP-9).

—Production of Magenta Toner 19—

A magenta toner 19 is produced in the same manner as in the production of the magenta toner 18, except that the polyester resin (1) is replaced with the polyester resin (4).

—Production of Magenta Toner 20—

A magenta toner 20 is produced in the same manner as in the production of the magenta toner 18, except that the paraffin wax used in the production of the magenta toner 18 is changed to PE130 (polyethylene wax (manufactured by Clariant Corp.)).

[Production of Yellow Toners]

| - Production of yellow toner 1 - | |
|---|---|
| Polyester resin dispersion liquid (A1) | 255 parts |
| Polyester resin dispersion liquid (A2) | 50 parts |
| Colorant dispersion liquid (B2) | 35 parts |
| Colorant dispersion liquid (B3) | 5 parts |
| Release agent dispersion liquid (C1) | 10 parts |
| Release agent dispersion liquid (C2) | 30 parts |

A yellow toner 1 is produced in the same manner as in the production of the cyan toner 1, except that the amounts of the polyester resin dispersion liquid, the colorant dispersion liquid and the release agent dispersion liquid used are changed to the amounts described above.

—Production of Yellow Toner 2—

A yellow toner 2 is produced in the same manner as in the production of the yellow toner 1, except that the amounts of the polyester resin dispersion liquids, colorant dispersion liquids and the release agent dispersion liquids are changed to the following amounts: 205 parts of the polyester resin dispersion liquid (A1), 100 parts of the polyester resin dispersion liquid (A2), 35 parts of the colorant dispersion liquid (B2), 5 parts of the colorant dispersion liquid (B3), and 40 parts of the release agent dispersion liquid (C1).

—Production of Yellow Toner 3—

A yellow toner 3 is produced in the same manner as in the production of the yellow toner 1, except that the amounts of the polyester resin dispersion liquids, colorant dispersion liquids and the release agent dispersion liquids are changed to the following amounts: 265 parts of the polyester resin dispersion liquid (A1), 40 parts of the polyester resin dispersion liquid (A2), 35 parts of the colorant dispersion liquid (B2), 5 parts of the colorant dispersion liquid (B3), 20 parts of the release agent dispersion liquid (C1), and 20 parts of the release agent dispersion liquid (C2).

—Production of Yellow Toner 4—

A yellow toner 4 is produced in the same manner as in the production of the yellow toner 1, except that the amounts of the polyester resin dispersion liquids, colorant dispersion liquids and the release agent dispersion liquids are changed to the following amounts: 230 parts of the polyester resin dispersion liquid (A1), 75 parts of the polyester resin dispersion liquid (A2), 35 parts of the colorant dispersion liquid (B2), 5 parts of the colorant dispersion liquid (B3), 30 parts of the release agent dispersion liquid (C1), and 10 parts of the release agent dispersion liquid (C2).

—Production of Yellow Toner 5—

A yellow toner 5 is produced in the same manner as in the production of the yellow toner 1, except that the amounts of the polyester resin dispersion liquids, colorant dispersion liquids and the release agent dispersion liquids are changed to the following amounts: 265 parts of the polyester resin dispersion liquid (A1), 40 parts of the polyester resin dispersion liquid (A2), 35 parts of the colorant dispersion liquid (B2), 5 parts of the colorant dispersion liquid (B3), 15 parts of the release agent dispersion liquid (C1), and 25 parts of the release agent dispersion liquid (C2).

—Production of Yellow Toner 6—

A yellow toner 6 is produced in the same manner as in the production of the yellow toner 1, except that the amounts of the polyester resin dispersion liquids, colorant dispersion liquids and the release agent dispersion liquids are changed to the following amounts: 245 parts of the polyester resin dispersion liquid (A1), 60 parts of the polyester resin dispersion liquid (A2), 35 parts of the colorant dispersion liquid (B2), 5 parts of the colorant dispersion liquid (B3), 35 parts of the release agent dispersion liquid (C1), and 5 parts of the release agent dispersion liquid (C5).

—Production of Yellow Toner 7—

A yellow toner 7 is produced in the same manner as in the production of the yellow toner 1, except that the amounts of the polyester resin dispersion liquids, colorant dispersion liquids and the release agent dispersion liquids are changed to the following amounts: 255 parts of the polyester resin dispersion liquid (A1), 50 parts of the polyester resin dispersion liquid (A2), 35 parts of the colorant dispersion liquid (B2), 5 parts of the colorant dispersion liquid (B3), 15 parts of the release agent dispersion liquid (C1), and 25 parts of the release agent dispersion liquid (C2).

—Production of Yellow Toner 8—

A yellow toner 8 is produced in the same manner as in the production of the yellow toner 1, except that the amounts of the polyester resin dispersion liquids, colorant dispersion liquids and the release agent dispersion liquids are changed to the following amounts: 305 parts of the polyester resin dispersion liquid (A2), 35 parts of the colorant dispersion liquid (B2), 5 parts of the colorant dispersion liquid (B3), 35 parts of the release agent dispersion liquid (C1), and 5 parts of the release agent dispersion liquid (C5). Furthermore, the polyester resin dispersion liquid that is additionally added is the polyester resin dispersion liquid (A2).

—Production of Yellow Toner 9—

A yellow toner 9 is produced in the same manner as in the production of the yellow toner 1, except that the amounts of the polyester resin dispersion liquids, colorant dispersion liquids and the release agent dispersion liquids are changed to the following amounts: 50 parts of the polyester resin dispersion liquid (A1), 255 parts of the polyester resin dispersion liquid (A2), 35 parts of the colorant dispersion liquid (B2), 5 parts of the colorant dispersion liquid (B3), and 40 parts of the release agent dispersion liquid (C1). Furthermore, the polyester resin dispersion liquid that is additionally added is the polyester resin dispersion liquid (A2).

—Production of Yellow Toner 10—

A yellow toner 10 is produced in the same manner as in the production of the yellow toner 1, except that the amounts of the polyester resin dispersion liquids, colorant dispersion liquids and the release agent dispersion liquids are changed to the following amounts: 265 parts of the polyester resin dispersion liquid (A1), 40 parts of the polyester resin dispersion liquid (A2), 35 parts of the colorant dispersion liquid (B2), 5 parts of the colorant dispersion liquid (B3), and 40 parts of the release agent dispersion liquid (C1).

—Production of Yellow Toner 11—

A yellow toner 11 is produced in the same manner as in the production of the yellow toner 1, except that the amounts of the polyester resin dispersion liquids, colorant dispersion liquids and the release agent dispersion liquids are changed to the following amounts: 295 parts of the polyester resin dispersion liquid (A3), 10 parts of the polyester resin dispersion liquid (A2), 40 parts of the colorant dispersion liquid (B2), and 40 parts of the release agent dispersion liquid (C2).

—Production of Yellow Toner 12—

A yellow toner 12 is produced in the same manner as in the production of the yellow toner 1, except that the amounts of the polyester resin dispersion liquids, colorant dispersion liquids and the release agent dispersion liquids are changed to the following amounts: 40 parts of the polyester resin dispersion liquid (A1), 250 parts of the polyester resin dispersion liquid (A4), 40 parts of the colorant dispersion liquid (B2), 50 parts of the release agent dispersion liquid (C5), and 5 parts of the release agent dispersion liquid (C1). Furthermore, the polyester resin dispersion liquid that is additionally added is the polyester resin dispersion liquid (A4).

—Production of Yellow Toner 13—

A yellow toner 13 is produced in the same manner as in the production of the yellow toner 1, except that the amounts of the polyester resin dispersion liquids, colorant dispersion liquids and the release agent dispersion liquids are changed to the following amounts: 50 parts of the polyester resin dispersion liquid (A1), 250 parts of the polyester resin dispersion liquid (A4), 40 parts of the colorant dispersion liquid (B2), 40 parts of the release agent dispersion liquid (C5), and 5 parts of the release agent dispersion liquid (C1). Furthermore, the polyester resin dispersion liquid that is additionally added is the polyester resin dispersion liquid (A4).

—Production of Yellow Toner 14—

A yellow toner 14 is produced in the same manner as in the production of the yellow toner 1, except that the amounts of the polyester resin dispersion liquids, colorant dispersion liquids and the release agent dispersion liquids are changed to the following amounts: 280 parts of the polyester resin dispersion liquid (A1), 25 parts of the polyester resin dispersion liquid (A2), 35 parts of the colorant dispersion liquid (B2), 5 parts of the colorant dispersion liquid (B3), 5 parts of the release agent dispersion liquid (C1), and 35 parts of the release agent dispersion liquid (C3).

—Production of Yellow Toner 15—

A yellow toner 15 is produced in the same manner as in the production of the yellow toner 1, except that the amounts of the polyester resin dispersion liquids, colorant dispersion liquids and the release agent dispersion liquids are changed to the following amounts: 255 parts of the polyester resin dispersion liquid (A1), 50 parts of the polyester resin dispersion liquid (A3), 35 parts of the colorant dispersion liquid (B2), 5 parts of the colorant dispersion liquid (B3), 5 parts of the release agent dispersion liquid (C1), and 35 parts of the release agent dispersion liquid (C3).

—Production of Yellow Toner 16—

A yellow toner 16 is produced in the same manner as in the production of the yellow toner 1, except that the amounts of the polyester resin dispersion liquids, colorant dispersion liquids and the release agent dispersion liquids are changed to the following amounts: 280 parts of the polyester resin dispersion liquid (A2), 25 parts of the polyester resin dispersion liquid (A3), 40 parts of the colorant dispersion liquid (B2), and 40 parts of the release agent dispersion liquid (C1). Furthermore, the polyester resin dispersion liquid that is additionally added is the polyester resin dispersion liquid (A2).

—Production of Yellow Toner 17—

A yellow toner 17 is produced in the same manner as in the production of the yellow toner 1, except that the amounts of the polyester resin dispersion liquids, colorant dispersion liquids and the release agent dispersion liquids are changed to the following amounts: 305 parts of the polyester resin dispersion liquid (A2), 35 parts of the colorant dispersion liquid (B2), 5 parts of the colorant dispersion liquid (B3), 37.5 parts of the release agent dispersion liquid (C1), and 2.5 parts of the release agent dispersion liquid (C5). Furthermore, the polyester resin dispersion liquid that is additionally added is the polyester resin dispersion liquid (A2).

—Production of Yellow Toner 18—

A yellow toner 18 is produced in the same manner as in the production of the yellow toner 1, except that the amounts of the polyester resin dispersion liquids, colorant dispersion liquids and the release agent dispersion liquids are changed to the following amounts: 230 parts of the polyester resin dispersion liquid (A1), 75 parts of the polyester resin dispersion liquid (A2), 35 parts of the colorant dispersion liquid (B2), 5 parts of the colorant dispersion liquid (B3), 35 parts of the release agent dispersion liquid (C1), and 5 parts of the release agent dispersion liquid (C2).

—Production of Yellow Toner 19—

A yellow toner 19 is produced in the same manner as in the production of the yellow toner 1, except that the amounts of the polyester resin dispersion liquids, colorant dispersion liquids and the release agent dispersion liquids are changed to the following amounts: 290 parts of the polyester resin dispersion liquid (A1), 15 parts of the polyester resin dispersion liquid (A3), 35 parts of the colorant dispersion liquid (B2), 5 parts of the colorant dispersion liquid (B3), 35 parts of the release agent dispersion liquid (C1), and 5 parts of the release agent dispersion liquid (C5).

—Production of Yellow Toner 20—

A yellow toner 20 is produced in the same manner as in the production of the yellow toner 1, except that the amounts of the polyester resin dispersion liquids, colorant dispersion liquids and the release agent dispersion liquids are changed to the following amounts: 295 parts of the polyester resin dispersion liquid (A3), 10 parts of the polyester resin dispersion liquid (A2), 40 parts of the colorant dispersion liquid (B2), 35 parts of the release agent dispersion liquid (C2), and 5 parts of the release agent dispersion liquid (C3). Furthermore, the polyester resin dispersion liquid that is additionally added is the polyester resin dispersion liquid (A3).

—Production of Yellow Toner 21—

A yellow toner 21 is produced in the same manner as in the production of the yellow toner 1, except that the amounts of the polyester resin dispersion liquids, colorant dispersion liquids and the release agent dispersion liquids are changed to the following amounts: 265 parts of the polyester resin dispersion liquid (A1), 40 parts of the polyester resin dispersion liquid (A2), 35 parts of the colorant dispersion liquid (B2), 5 parts of the colorant dispersion liquid (B3), 10 parts of the release agent dispersion liquid (C1), and 30 parts of the release agent dispersion liquid (C2).

—Production of Yellow Toner 22—

A yellow toner 22 is produced in the same manner as in the production of the yellow toner 1, except that the amounts of the polyester resin dispersion liquids, colorant dispersion liquids and the release agent dispersion liquids are changed to the following amounts: 280 parts of the polyester resin dispersion liquid (A1), 25 parts of the polyester resin dispersion liquid (A3), 35 parts of the colorant dispersion liquid (B2), 5 parts of the colorant dispersion liquid (B3), 10 parts of the release agent dispersion liquid (C1), and 30 parts of the release agent dispersion liquid (C3).

—Production of Yellow Toner 23—

A yellow toner 23 is produced in the same manner as in the production of the yellow toner 1, except that the amounts of the polyester resin dispersion liquids, colorant dispersion liquids and the release agent dispersion liquids are changed to the following amounts: 280 parts of the polyester resin dispersion liquid (A1), 25 parts of the polyester resin dispersion liquid (A3), 35 parts of the colorant dispersion liquid (B2), 5 parts of the colorant dispersion liquid (B3), 30 parts of the release agent dispersion liquid (C1), and 10 parts of the release agent dispersion liquid (C2).

—Production of Yellow Toner 24—

A yellow toner 24 is produced in the same manner as in the production of the yellow toner 1, except that the amounts of the polyester resin dispersion liquids, colorant dispersion liquids and the release agent dispersion liquids are changed to the following amounts: 60 parts of the polyester resin dispersion liquid (A1), 245 parts of the polyester resin dispersion liquid (A4), 40 parts of the colorant dispersion liquid (B2), 10 parts of the release agent dispersion liquid (C1), and 30 parts of the release agent dispersion liquid (C5). Furthermore, the polyester resin dispersion liquid that is additionally added is the polyester resin dispersion liquid (A4).

—Production of Yellow Toner 25—

A yellow toner 25 is produced in the same manner as in the production of the yellow toner 1, except that the amounts of the polyester resin dispersion liquids, colorant dispersion liquids and the release agent dispersion liquids are changed to the following amounts: 30 parts of the polyester resin dispersion liquid (A1), 260 parts of the polyester resin dispersion liquid (A4), 40 parts of the colorant dispersion liquid (B2), 5 parts of the release agent dispersion liquid (C1), and 50 parts of the release agent dispersion liquid (C5). Furthermore, the polyester resin dispersion liquid that is additionally added is the polyester resin dispersion liquid (A4).

—Production of Yellow Toner 26—

A yellow toner 26 is produced in the same manner as in the production of the yellow toner 1, except that the amounts of the polyester resin dispersion liquids, colorant dispersion liquids and the release agent dispersion liquids are changed to the following amounts: 60 parts of the polyester resin dispersion liquid (A1), 245 parts of the polyester resin dispersion liquid (A4), 40 parts of the colorant dispersion liquid (B2), 20 parts of the release agent dispersion liquid (C1), and 20 parts of the release agent dispersion liquid (C5). Furthermore, the polyester resin dispersion liquid that is additionally added is the polyester resin dispersion liquid (A4).

—Production of Yellow Toner 27—

A yellow toner 27 is produced in the same manner as in the production of the yellow toner 1, except that the amounts of the polyester resin dispersion liquids, colorant dispersion liquids and the release agent dispersion liquids are changed to the following amounts: 75 parts of the polyester resin dispersion liquid (A1), 230 parts of the polyester resin dispersion liquid (A2), 35 parts of the colorant dispersion liquid (B2), 5 parts of the colorant dispersion liquid (B3), and 40 parts of the release agent dispersion liquid (C1). Furthermore, the polyester resin dispersion liquid that is additionally added is the polyester resin dispersion liquid (A2).

—Production of Yellow Toner 28—

A yellow toner 28 is produced in the same manner as in the production of the yellow toner 1, except that the amounts of the polyester resin dispersion liquids, colorant dispersion liquids and the release agent dispersion liquids are changed to the following amounts: 25 parts of the polyester resin dispersion liquid (A2), 280 parts of the polyester resin dispersion liquid (A3), 40 parts of the colorant dispersion liquid (B2), and 40 parts of the release agent dispersion liquid (C2). Furthermore, the polyester resin dispersion liquid that is additionally added is the polyester resin dispersion liquid (A3).

—Production of Yellow Toner 29—

A yellow toner 29 is produced in the same manner as in the production of the yellow toner 1, except that the amounts of the polyester resin dispersion liquids, colorant dispersion liquids and the release agent dispersion liquids are changed to the following amounts: 255 parts of the polyester resin dispersion liquid (A1), 50 parts of the polyester resin dispersion liquid (A2), 35 parts of the colorant dispersion liquid (B2), 5 parts of the colorant dispersion liquid (B3), 10 parts of the release agent dispersion liquid (C1), and 30 parts of the release agent dispersion liquid (C3).

—Production of Yellow Toner 30—

A yellow toner 30 is produced in the same manner as in the production of the yellow toner 1, except that the amounts of the polyester resin dispersion liquids, colorant dispersion liquids and the release agent dispersion liquids are changed to the following amounts: 285 parts of the polyester resin dispersion liquid (A3), 20 parts of the polyester resin dispersion liquid (A2), 40 parts of the colorant dispersion liquid (B2), 30 parts of the release agent dispersion liquid (C2), and 10 parts of the release agent dispersion liquid (C3). Furthermore, the polyester resin dispersion liquid that is additionally added is the polyester resin dispersion liquid (A3).

—Production of Yellow Toner 31—

A yellow toner 31 is produced in the same manner as in the production of the yellow toner 1, except that the amounts of the polyester resin dispersion liquids, colorant dispersion liquids and the release agent dispersion liquids are changed to the following amounts: 255 parts of the polyester resin dispersion liquid (A1), 50 parts of the polyester resin dispersion liquid (A2), 40 parts of the colorant dispersion liquid (B3), 10 parts of the release agent dispersion liquid (C1), and 30 parts of the release agent dispersion liquid (C2).

—Production of Yellow Toner 32—

A yellow toner 32 is produced in the same manner as in the production of the yellow toner 1, except that the amounts of the polyester resin dispersion liquids, colorant dispersion liquids and the release agent dispersion liquids are changed to the following amounts: 50 parts of the polyester resin dispersion liquid (A1), 255 parts of the polyester resin dispersion liquid (A4), 40 parts of the colorant dispersion liquid (B3), 10 parts of the release agent dispersion liquid (C1), and 30 parts of the release agent dispersion liquid (C5). Furthermore, the polyester resin dispersion liquid that is additionally added is the polyester resin dispersion liquid (A4).

—Production of Yellow Toner 33—

A yellow toner 33 is produced in the same manner as in the production of the yellow toner 1, except that the amounts of the polyester resin dispersion liquids, colorant dispersion liquids and the release agent dispersion liquids are changed to the following amounts: 60 parts of the polyester resin dispersion liquid (A1), 245 parts of the polyester resin dispersion liquid (A4), 40 parts of the colorant dispersion liquid (B3), 20 parts of the release agent dispersion liquid (C1), and 20 parts of the release agent dispersion liquid (C5). Furthermore, the polyester resin dispersion liquid that is additionally added is the polyester resin dispersion liquid (A4).

—Production of Yellow Toner 34—

A yellow toner 34 is produced in the same manner as in the production of the yellow toner 1, except that the amounts of the polyester resin dispersion liquids, colorant dispersion liquids and the release agent dispersion liquids are changed to the following amounts: 255 parts of the polyester resin dispersion liquid (A1), 50 parts of the polyester resin dispersion liquid (A3), 40 parts of the colorant dispersion liquid (B3), 5 parts of the release agent dispersion liquid (C1), and 35 parts of the release agent dispersion liquid (C3).

—Production of Yellow Toner 35—

A yellow toner 35 is produced in the same manner as in the production of the yellow toner 1, except that the amounts of the polyester resin dispersion liquids, colorant dispersion liquids and the release agent dispersion liquids are changed to the following amounts: 280 parts of the polyester resin dispersion liquid (A3), 25 parts of the polyester resin dispersion liquid (A2), 40 parts of the colorant dispersion liquid (B3), 30 parts of the release agent dispersion liquid (C2), and 10 parts of the release agent dispersion liquid (C3). Furthermore, the polyester resin dispersion liquid that is additionally added is the polyester resin dispersion liquid (A3).

—Production of Yellow Toner 36—

A yellow toner 36 is produced in the same manner as in the production of the yellow toner 1, except that the amounts of the polyester resin dispersion liquids, colorant dispersion liquids and the release agent dispersion liquids are changed to the following amounts: 290 parts of the polyester resin dispersion liquid (A4), 40 parts of the colorant dispersion liquid (B2), and 55 parts of the release agent dispersion liquid (C5). Furthermore, the polyester resin dispersion liquid that is additionally added is the polyester resin dispersion liquid (A4).

—Production of Yellow Toner 37—

A yellow toner 37 is produced in the same manner as in the production of the yellow toner 1, except that the amounts of the polyester resin dispersion liquids, colorant dispersion liquids and the release agent dispersion liquids are changed to the following amounts: 230 parts of the polyester resin dispersion liquid (A1), 75 parts of the polyester resin dispersion liquid (A3), 40 parts of the colorant dispersion liquid (B2), 10 parts of the release agent dispersion liquid (C1), and 30 parts of the release agent dispersion liquid (C4).

—Production of Yellow Toner 38—

A yellow toner 38 is produced in the same manner as in the production of the yellow toner 1, except that the amounts of the polyester resin dispersion liquids, colorant dispersion liquids and the release agent dispersion liquids are changed to the following amounts: 225 parts of the polyester resin dispersion liquid (A1), 90 parts of the polyester resin dispersion liquid (A3), 40 parts of the colorant dispersion liquid (B2), 5 parts of the release agent dispersion liquid (C1), and 25 parts of the release agent dispersion liquid (C4).

—Production of Yellow Toner 39—

A yellow toner 39 is produced in the same manner as in the production of the yellow toner 1, except that the monodisperse spherical sol-gel silica is not added, and 2 parts of titanium oxide particles (volume average particle size 20 nm) are added.

—Production of Yellow Toner 40—

A yellow toner 40 is produced in the same manner as in the production of the yellow toner 12, except that the monodisperse spherical sol-gel silica is not added, and 2 parts of titanium oxide particles (volume average particle size 20 nm) are added.

—Production of Yellow Toner 41—

A yellow toner 41 is produced in the same manner as in the production of the yellow toner 15, except that the monodisperse spherical sol-gel silica is not added, and 2 parts of titanium oxide particles (volume average particle size 20 nm) are added.

—Production of Yellow Toner 42—

A yellow toner 42 is produced in the same manner as in the production of the yellow toner 30, except that the monodisperse spherical sol-gel silica is not added, and 2 parts of titanium oxide particles (volume average particle size 20 nm) are added.

—Production of Yellow Toner 43—

A yellow toner 43 is produced in the same manner as in the production of the yellow toner 26, except that the monodisperse spherical sol-gel silica is not added, and 2 parts of titanium oxide particles (volume average particle size 20 nm) are added.

—Production of Yellow Toner 44—

A yellow toner 44 is produced in the same manner as in the production of the cyan toner 15, except that the components are changed to 71 parts by mass of the polyester resin (1), 10 parts by mass of the polyester resin (2), 3 parts by mass of the polyester resin (3), 7 parts of Y17 (manufactured by Dainichiseika Color & Chemicals Manufacturing Co., Ltd., SEIKA FAST YELLOW 2400 (B)) and 1 part of Y110 (manufactured by BASF Corp., CROMOPHTAL YELLOW 2RLP) as colorants, and 2 parts by mass of HNP-9 and 6 parts of POLYWAX655 as release agents.

—Production of Yellow Toner 45—

A yellow toner 45 is produced in the same manner as in the production of the yellow toner 44, except that the components are changed to 8 parts by mass of the polyester resin (1), 63 parts by mass of the polyester resin (4) instead of the polyester resin (2), 7 parts of Y17 and 1 part of Y110 as colorants, and 1 part by mass of HNP-9 and 10 parts of EW861 as release agents.

—Production of Yellow Toner 46—

A yellow toner 46 is produced in the same manner as in the production of the yellow toner 44, except that the amounts of the binder resins are changed to 71 parts of the polyester resin (1) and 13 parts of the polyester resin (3), and the amounts of the release agents are changed to 1 part by mass of HNP-9 and 7 parts of PE130.

—Production of Yellow Toner 47—

A yellow toner 47 is produced in the same manner as in the production of the yellow toner 44, except that the amounts of the binder resins are changed to 12 parts of the polyester resin (1), 3 parts of the polyester resin (3) and 69 parts of the polyester resin (4); the amount of the colorant is changed to 8 parts of Y17; and the amounts of the release agents are changed to 4 part by mass of HNP-9 and 4 parts of EW861.

—Production of Yellow Toner 48—

A yellow toner 48 is produced in the same manner as in the production of the yellow toner 44, except that the amounts of the binder resins are changed to 81 parts of the polyester resin (3) and 3 parts of the polyester resin (2); the amount of the colorant is changed to 8 parts of Y17; and the amounts of the release agents are changed to 6 part of POLYWAX655 and 2 parts of PE130.

Examples 1 to 57, and Comparative Examples 1 to 10

Toner sets of the Examples and the Comparative Examples are respectively prepared by combining the cyan toners 1 to 17 (may be described as C1 to C17), magenta toners 1 to 20 (may be described as M1 to M20), and yellow toners 1 to 48 (may be described as Y1 to Y48) according to Table 3 and Table 4.

The Vicat softening temperatures of the toners, and the Vicat softening temperature difference of the toners in the toner set (max−min: difference between the Vicat softening temperature of the toner having the highest Vicat softening temperature and the Vicat softening temperature of the toner having the lowest Vicat softening temperature) for each of the Examples are indicated in Table 3 and Table 4.

[Evaluation]

—Production of Developer Set—

8 parts by mass of each of the toners of the toner set obtained in each Example, and 92 parts by mass of a carrier shown below are introduced into a V-blender and are stirred for 20 minutes. Subsequently, the mixture is classified with a mesh sieve having a pore size of 212 μm to thereby prepare each developer, and thus a developer set is prepared for each Example.

| - Preparation of carrier - | |
|---|---|
| Ferrite particles (average particle size: 35 μm) | 100 parts by mass |
| Toluene | 14 parts by mass |
| Methyl-methacrylate-perfluorooctyl ethyl methacrylate copolymer (copolymerization ratio 8:2), Mw 76000 | 1.6 parts by mass |

These components are dispersed using a sand mill, and the dispersion is stirred for 10 minutes with a stirrer to prepare a liquid for coating layer formation. Subsequently, this liquid for coating layer formation and ferrite particles (45 μm) are introduced into a vacuum degassing kneader and are stirred for 30 minutes at a temperature of 60° C. Subsequently, toluene is distilled off under reduced pressure, and a resin coating layer is formed. Thus, a carrier is obtained.

—Machine Evaluation—

A modified printer of Color 1000 Press manufactured by Fuji Xerox Co., Ltd. (the machine is modified such that the speed of paper passage and the nip width are variable; printing is enabled, even if no developers are available in the developing machine, as long as at least one developer is available in the developing machine; and the fixing apparatus is a roll-roll system in which the contact width is set to 6 mm; and the fixing time is set to 24 ms) is used, and the respective developers of a developer set thus obtained are filled in the developing machines for the respective colors, while the respective toners of a toner set thus obtained are filled in the cartridges for the respective colors. (a) One hundred sheets of solid images are continuously printed out in an amount of toner load of 3 g/m$^2$ in an environment of a temperature of 15° C. and a humidity of 30%. (b) Subsequently, the printer is left to stand for 24 hours in an environment of a temperature of 30° C. and a humidity of 85%, and after the standing, 100,000 sheets of the image of Test Chart No. 5-1 of the Imaging Society of Japan are printed out. (c) After completion, the printer is left to stand for 24 hours in an environment of a temperature of 15° C. and a humidity of 30%. The operation of the steps (a) to (c) is repeated until 500,000 sheets are printed out. The evaluation is carried out at an interval of 100,000 sheets, and an evaluation of the boundary areas of the "fruit part" of the image area is carried out by visual inspection.

The evaluation criteria are as follows.

A: No cracking or image peeling is confirmed until the 500,000$^{th}$ sheet.

B: No cracking or image peeling is confirmed until the 400,000$^{th}$ sheet, but cracking or image peeling is confirmed in the 500,000$^{th}$ sheet.

C: No cracking or image peeling is confirmed until the 300,000th sheet, but cracking or image peeling is confirmed in the 400,000$^{th}$ sheet.

D: No cracking or image peeling is confirmed until the 200,000$^{th}$ sheet, but cracking or image peeling is confirmed in the 300,000$^{th}$ sheet.

E: No cracking or image peeling is confirmed until the 100,000$^{th}$ sheet, but cracking or image peeling is confirmed in the 200,000$^{th}$ sheet.

F: Cracking or image peeling is confirmed in the 100,000$^{th}$ sheet.

*1: There is a problem with the color reproducibility of the "fruit" image.

Furthermore, the evaluation described above is designated as "Evaluation 1," and evaluations are further carried out such that "Evaluation 2" through "Evaluation 13" are carried out under the conditions shown below. The evaluation criteria are the same as those of the "Evaluation 1."

Evaluation 2: The contact width is set to 3 mm, and the fixing time is set to 10 ms.

Evaluation 3: The contact width is set to 10 mm, and the fixing time is set to 40 ms.

Evaluation 4: The contact width is set to 3 mm, and the fixing time is set to 40 ms.

Evaluation 5: The contact width is set to 10 mm, and the fixing time is set to 10 ms.

Evaluation 6: The contact width is set to 2.8 mm, and the fixing time is set to 10 ms.

Evaluation 7: The contact width is set to 3 mm, and the fixing time is set to 9.8 ms.

Evaluation 8: The contact width is set to 10 mm, and the fixing time is set to 9.8 ms.

Evaluation 9: The contact width is set to 10.2 mm, and the fixing time is set to 10 ms.

Evaluation 10: The contact width is set to 10.2 mm, and the fixing time is set to 40 ms.

Evaluation 11: The contact width is set to 10 mm, and the fixing time is set to 40.2 ms.

Evaluation 12: The contact width is set to 3 mm, and the fixing time is set to 40.2 ms.

Evaluation 13: The contact width is set to 2.8 mm, and the fixing time is set to 40 ms.

The evaluation results are shown in Tables 5 and 6.

TABLE 3

| | Toner | | | Vicat softening temperature of each toner in toner set [° C.] | | | Difference in Vicat softening temperature of toners in toner set max − min |
|---|---|---|---|---|---|---|---|
| | C | M | Y | C | M | Y | [° C.] |
| Example 1 | C1 | M1 | Y1 | 45.1 | 45.2 | 47.1 | 2.0 |
| Example 2 | C2 | M2 | Y2 | 41.3 | 41.5 | 40.3 | 1.2 |
| Example 3 | C3 | M3 | Y3 | 49.3 | 49.6 | 48.3 | 1.3 |
| Example 4 | C2 | M2 | Y4 | 41.3 | 41.5 | 44.1 | 2.8 |
| Example 5 | C3 | M3 | Y5 | 49.3 | 49.6 | 46.8 | 2.8 |
| Example 6 | C2 | M2 | Y6 | 41.3 | 41.5 | 44.7 | 3.4 |
| Example 7 | C3 | M3 | Y7 | 49.3 | 49.6 | 46.0 | 3.6 |
| Example 8 | C2 | M2 | Y7 | 41.3 | 41.5 | 46.0 | 4.7 |
| Example 9 | C3 | M3 | Y6 | 49.3 | 49.6 | 44.7 | 4.9 |
| Example 10 | C5 | M5 | Y8 | 35.5 | 36.1 | 36.8 | 1.3 |
| Example 11 | C4 | M4 | Y9 | 39.2 | 39.7 | 38.4 | 1.3 |
| Example 12 | C5 | M5 | Y9 | 35.5 | 36.1 | 38.4 | 2.9 |
| Example 13 | C4 | M4 | Y8 | 39.2 | 39.7 | 36.8 | 2.9 |
| Example 14 | C6 | M6 | Y10 | 51.1 | 50.5 | 51.8 | 1.3 |
| Example 15 | C7 | M7 | Y11 | 54.6 | 54.0 | 53.3 | 1.3 |
| Example 16 | C6 | M6 | Y11 | 51.1 | 50.5 | 53.3 | 2.8 |
| Example 17 | C7 | M7 | Y10 | 54.6 | 54.0 | 51.8 | 2.8 |
| Example 18 | C8 | M8 | Y12 | 30.8 | 31.1 | 32.0 | 1.2 |
| Example 19 | C9 | M9 | Y13 | 34.5 | 34.6 | 33.5 | 1.1 |
| Example 20 | C8 | M8 | Y13 | 30.8 | 31.1 | 33.5 | 2.7 |
| Example 21 | C9 | M9 | Y12 | 34.5 | 34.6 | 32.0 | 2.6 |
| Example 22 | C10 | M10 | Y14 | 55.5 | 56.1 | 56.7 | 1.2 |
| Example 23 | C11 | M11 | Y15 | 59.3 | 59.2 | 58.1 | 1.2 |
| Example 24 | C10 | M10 | Y15 | 55.5 | 56.1 | 58.1 | 2.6 |
| Example 25 | C11 | M11 | Y14 | 59.3 | 59.2 | 56.7 | 2.6 |
| Example 26 | C5 | M5 | Y16 | 35.5 | 36.1 | 38.7 | 3.2 |
| Example 27 | C4 | M4 | Y17 | 39.2 | 39.7 | 36.5 | 3.2 |
| Example 28 | C5 | M5 | Y18 | 35.5 | 36.1 | 40.2 | 4.7 |
| Example 29 | C4 | M4 | Y19 | 39.2 | 39.7 | 44.0 | 4.8 |
| Example 30 | C6 | M6 | Y20 | 51.1 | 50.5 | 53.6 | 3.1 |

TABLE 4

| | Toner | | | Vicat softening temperature of each toner in toner set [° C.] | | | Difference in Vicat softening temperature of toners in toner set max − min |
|---|---|---|---|---|---|---|---|
| | C | M | Y | C | M | Y | [° C.] |
| Example 31 | C7 | M7 | Y21 | 54.6 | 54.0 | 51.4 | 3.2 |
| Example 32 | C6 | M6 | Y22 | 51.1 | 50.5 | 55.3 | 4.8 |
| Example 33 | C7 | M7 | Y23 | 54.6 | 54.0 | 49.8 | 4.8 |
| Example 34 | C8 | M8 | Y24 | 30.8 | 31.1 | 34.0 | 3.2 |
| Example 35 | C9 | M9 | Y25 | 34.5 | 34.6 | 31.3 | 3.3 |
| Example 36 | C8 | M8 | Y26 | 30.8 | 31.1 | 35.5 | 4.7 |
| Example 37 | C9 | M9 | Y27 | 34.5 | 34.6 | 39.2 | 4.7 |
| Example 38 | C10 | M10 | Y28 | 55.5 | 56.1 | 53.0 | 3.1 |
| Example 39 | C11 | M11 | Y29 | 59.3 | 59.2 | 56.0 | 3.3 |
| Example 40 | C10 | M10 | Y21 | 55.5 | 56.1 | 51.4 | 4.7 |
| Example 41 | C11 | M11 | Y30 | 59.3 | 59.2 | 54.5 | 4.8 |
| Example 42 | C1 | M1 | Y31 | 45.1 | 45.2 | 47.1 | 2.0 |
| Example 43 | C1 | M12 | Y31 | 45.1 | 45.2 | 47.1 | 2.0 |
| Example 44 | C8 | M13 | Y32 | 30.8 | 31.1 | 32.0 | 1.2 |
| Example 45 | C8 | M13 | Y33 | 30.8 | 31.1 | 35.5 | 4.7 |
| Example 46 | C11 | M14 | Y34 | 59.3 | 59.2 | 58.1 | 1.2 |
| Example 47 | C11 | M14 | Y35 | 59.3 | 59.2 | 54.5 | 4.8 |
| Example 48 | C12 | M15 | Y39 | 45.1 | 45.2 | 47.1 | 2.0 |
| Example 49 | C13 | M16 | Y40 | 30.8 | 31.1 | 35.5 | 4.7 |
| Example 50 | C14 | M17 | Y41 | 59.3 | 59.2 | 58.1 | 1.2 |
| Example 51 | C14 | M17 | Y42 | 59.3 | 59.2 | 54.5 | 4.8 |
| Example 52 | C13 | M16 | Y43 | 30.8 | 31.1 | 35.5 | 4.7 |
| Example 53 | C15 | M18 | Y44 | 45.3 | 45.4 | 46.8 | 1.5 |
| Example 54 | C16 | M19 | Y45 | 30.6 | 30.7 | 32.0 | 1.4 |
| Example 55 | C17 | M20 | Y46 | 59.0 | 58.8 | 57.8 | 1.2 |
| Example 56 | C17 | M20 | Y47 | 59.0 | 58.8 | 54.6 | 4.4 |
| Example 57 | C16 | M19 | Y48 | 30.6 | 30.7 | 35.2 | 4.6 |
| Comp. Ex. 1 | C8 | M8 | Y36 | 30.8 | 31.1 | 29.8 | 1.3 |
| Comp. Ex. 2 | C9 | M9 | Y36 | 34.5 | 34.6 | 29.8 | 4.8 |
| Comp. Ex. 3 | C8 | M8 | Y25 | 30.8 | 31.1 | 31.3 | 0.5 |
| Comp. Ex. 4 | C8 | M8 | Y17 | 30.8 | 31.1 | 36.5 | 5.7 |
| Comp. Ex. 5 | C1 | M1 | Y6 | 45.1 | 45.2 | 44.7 | 0.5 |
| Comp. Ex. 6 | C1 | M1 | Y21 | 45.1 | 45.2 | 51.4 | 6.3 |
| Comp. Ex. 7 | C11 | M11 | Y37 | 59.3 | 59.2 | 59.5 | 0.3 |
| Comp. Ex. 8 | C11 | M11 | Y28 | 59.3 | 59.2 | 53.0 | 6.3 |
| Comp. Ex. 9 | C11 | M14 | Y38 | 59.3 | 59.2 | 60.1 | 0.9 |
| Comp. Ex. 10 | C10 | M10 | Y38 | 55.5 | 56.1 | 60.1 | 4.6 |

TABLE 5

| | Evaluation 1 | Evaluation 2 | Evaluation 3 | Evaluation 4 | Evaluation 5 | Evaluation 6 | Evaluation 7 | Evaluation 8 | Evaluation 9 | Evaluation 10 | Evaluation 11 | Evaluation 12 | Evaluation 13 |
|---|---|---|---|---|---|---|---|---|---|---|---|---|---|
| Example 1 | A | A | A | A | A | B | B | B | B | B | B | B | B |
| Example 2 | A | A | A | A | A | B | B | B | B | B | B | B | B |
| Example 3 | A | A | A | A | A | B | B | B | B | B | B | B | B |
| Example 4 | A | A | A | A | A | B | B | B | B | B | B | B | B |
| Example 5 | A | A | A | A | A | B | B | B | B | B | B | B | B |
| Example 6 | B | B | B | B | B | C | C | C | C | C | C | C | C |
| Example 7 | B | B | B | B | B | C | C | C | C | C | C | C | C |
| Example 8 | B | B | B | B | B | C | C | C | C | C | C | C | C |
| Example 9 | B | B | B | B | B | C | C | C | C | C | C | C | C |
| Example 10 | B | B | B | B | B | C | C | C | C | C | C | C | C |
| Example 11 | B | B | B | B | B | C | C | C | C | C | C | C | C |
| Example 12 | B | B | B | B | B | C | C | C | C | C | C | C | C |
| Example 13 | B | B | B | B | B | C | C | C | C | C | C | C | C |
| Example 14 | B | B | B | B | B | C | C | C | C | C | C | C | C |
| Example 15 | B | B | B | B | B | C | C | C | C | C | C | C | C |
| Example 16 | B | B | B | B | B | C | C | C | C | C | C | C | C |

TABLE 5-continued

| | Evaluation 1 | Evaluation 2 | Evaluation 3 | Evaluation 4 | Evaluation 5 | Evaluation 6 | Evaluation 7 | Evaluation 8 | Evaluation 9 | Evaluation 10 | Evaluation 11 | Evaluation 12 | Evaluation 13 |
|---|---|---|---|---|---|---|---|---|---|---|---|---|---|
| Example 17 | B | B | B | B | B | C | C | C | C | C | C | C | C |
| Example 18 | C | C | C | C | C | D | D | D | D | D | D | D | D |
| Example 19 | C | C | C | C | C | D | D | D | D | D | D | D | D |
| Example 20 | C | C | C | C | C | D | D | D | D | D | D | D | D |
| Example 21 | C | C | C | C | C | D | D | D | D | D | D | D | D |
| Example 22 | C | C | C | C | C | D | D | D | D | D | D | D | D |
| Example 23 | C | C | C | C | C | D | D | D | D | D | D | D | D |
| Example 24 | C | C | C | C | C | D | D | D | D | D | D | D | D |
| Example 25 | C | C | C | C | C | D | D | D | D | D | D | D | D |
| Example 26 | C | C | C | C | C | D | D | D | D | D | D | D | D |
| Example 27 | C | C | C | C | C | D | D | D | D | D | D | D | D |
| Example 28 | C | C | C | C | C | D | D | D | D | D | D | D | D |
| Example 29 | C | C | C | C | C | D | D | D | D | D | D | D | D |
| Example 30 | C | C | C | C | C | D | D | D | D | D | D | D | D |

TABLE 6

| | Evaluation 1 | Evaluation 2 | Evaluation 3 | Evaluation 4 | Evaluation 5 | Evaluation 6 | Evaluation 7 | Evaluation 8 | Evaluation 9 | Evaluation 10 | Evaluation 11 | Evaluation 12 | Evaluation 13 |
|---|---|---|---|---|---|---|---|---|---|---|---|---|---|
| Example 31 | C | C | C | C | C | D | D | D | D | D | D | D | D |
| Example 32 | C | C | C | C | C | D | D | D | D | D | D | D | D |
| Example 33 | C | C | C | C | C | D | D | D | D | D | D | D | D |
| Example 34 | D | D | D | D | D | E | E | E | E | E | E | E | E |
| Example 35 | D | D | D | D | D | E | E | E | E | E | E | E | E |
| Example 36 | D | D | D | D | D | E | E | E | E | E | E | E | E |
| Example 37 | D | D | D | D | D | E | E | E | E | E | E | E | E |
| Example 38 | D | D | D | D | D | E | E | E | E | E | E | E | E |
| Example 39 | D | D | D | D | D | E | E | E | E | E | E | E | E |
| Example 40 | D | D | D | D | D | E | E | E | E | E | E | E | E |
| Example 41 | D | D | D | D | D | E | E | E | E | E | E | E | E |
| Example 42 | B | B | B | B | B | C | C | C | C | C | C | C | C |
| Example 43 | C | C | C | C | C | D | D | D | D | D | D | D | D |
| Example 44 | E | E | E | E | E | E | E | E | E | E | E | E | E |
| Example 45 | E | E | E | E | E | E | E | E | E | E | E | E | E |
| Example 46 | E | E | E | E | E | E | E | E | E | E | E | E | E |
| Example 47 | E | E | E | E | E | E | E | E | E | E | E | E | E |
| Example 48 | B | B | B | B | B | C | C | C | C | C | C | C | C |
| Example 49 | E | E | E | E | E | E | E | E | E | E | E | E | E |
| Example 50 | D | D | D | D | D | E | E | E | E | E | E | E | E |
| Example 51 | D | D | D | D | D | E | E | E | E | E | E | E | E |
| Example 52 | E | E | E | E | E | E | E | E | E | E | E | E | E |
| Example 53 | C | C | C | C | C | D | D | D | D | D | D | D | D |
| Example 54 | E | E | E | E | E | E | E | E | E | E | E | E | E |
| Example 55 | E | E | E | E | E | E | E | E | E | E | E | E | E |
| Example 56 | E | E | E | E | E | E | E | E | E | E | E | E | E |
| Example 57 | E | E | E | E | E | E | E | E | E | E | E | E | E |
| Comp. Ex. 1 | *1 | *1 | *1 | *1 | *1 | *1 | *1 | *1 | *1 | *1 | *1 | *1 | *1 |
| Comp. Ex. 2 | F | F | F | F | F | F | F | F | F | F | F | F | F |
| Comp. Ex. 3 | *1 | *1 | *1 | *1 | *1 | *1 | *1 | *1 | *1 | *1 | *1 | *1 | *1 |
| Comp. Ex. 4 | F | F | F | F | F | F | F | F | F | F | F | F | F |
| Comp. Ex. 5 | *1 | *1 | *1 | *1 | *1 | *1 | *1 | *1 | *1 | *1 | *1 | *1 | *1 |
| Comp. Ex. 6 | F | F | F | F | F | F | F | F | F | F | F | F | F |
| Comp. Ex. 7 | *1 | *1 | *1 | *1 | *1 | *1 | *1 | *1 | *1 | *1 | *1 | *1 | *1 |
| Comp. Ex. 8 | F | F | F | F | F | F | F | F | F | F | F | F | F |
| Comp. Ex. 9 | *1 | *1 | *1 | *1 | *1 | *1 | *1 | *1 | *1 | *1 | *1 | *1 | *1 |
| Comp. Ex. 10 | F | F | F | F | F | F | F | F | F | F | F | F | F |

From the results described above, it can be seen that in the Examples of the invention, cracking or image peeling in the boundary areas (between fixed areas of different colors) of the fruit part of the image area is suppressed as compared with the comparative examples. Furthermore, it can be seen that when the Vicat softening temperature is too low, or the difference in the Vicat softening temperature between different colors is small, there is a problem with the color reproducibility, instead of cracking or image peeling.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner set for electrostatic image development comprising:

a cyan toner;

a magenta toner; and a yellow toner, wherein the Vicat softening temperatures of the toners are respectively adjusted to be in the range of from about 30° C. to 58° C., and among the toners, the difference between the Vicat softening temperature of the toner having the highest Vicat softening temperature and the Vicat softening temperature of the toner having the lowest Vicat softening temperature is adjusted to be a value from about 1° C. to about 5° C.

2. The toner set for electrostatic image development of claim 1, further comprising:

a black toner, wherein the Vicat softening temperature of the black toner is in the range of from about 30° C. to about 60° C.

3. The toner set for electrostatic image development of claim 1, wherein the Vicat softening temperatures of the toners are respectively in the range of from about 35° C. to about 55° C.

4. The toner set for electrostatic image development of claim 1, wherein among the toners, the difference between the Vicat softening temperature of the toner having the highest Vicat softening temperature and the Vicat softening temperature of the toner having the lowest Vicat softening temperature is from about 1° C. to about 3° C.

5. The toner set for electrostatic image development of claim 1, wherein among the toners, the colorant of at least one of the toners is a pigment having an azo group.

6. The toner set for electrostatic image development of claim 1, wherein the colorant of the yellow toner is a pigment having an azo group.

7. The toner set for electrostatic image development of claim 1, wherein external additives of the toners contain two kinds of metal oxide particles having different volume average particle sizes.

8. A developer set for electrostatic image development, comprising the respective toners of the toner set for electrostatic image development of claim 1, and carriers respectively corresponding to the toners.

9. The developer set for electrostatic image development of claim 8, wherein among the toners of the toner set for the electrostatic image development, the difference between the Vicat softening temperature of the toner having the highest Vicat softening temperature and the Vicat softening temperature of the toner having the lowest Vicat softening temperature is from about 1° C. to about 3° C.

10. A method of developing an electrostatic image development using a toner set, the toner set comprising comprising a cyan toner, a magenta toner, and a yellow toner, the method comprising:

adjusting the Vicat softening temperatures of the toners, respectively, to be in the range of from about 30° C. to 58° C.; and among the toners, adjusting the difference between the Vicat softening temperature of the toner having the highest Vicat softening temperature and the Vicat softening temperature of the toner having the lowest Vicat softening temperature to be a value from about 1° C. to about 5° C.

* * * * *